US007028780B2

(12) United States Patent
Maguire

(10) Patent No.: US 7,028,780 B2
(45) **Date of Patent: *Apr. 18, 2006**

(54) EXPANDABLE HANGER WITH COMPLIANT SLIP SYSTEM

(75) Inventor: Patrick G. Maguire, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 179 days.

This patent is subject to a terminal disclaimer.

(21) Appl. No.: 10/458,064

(22) Filed: Jun. 10, 2003

(65) Prior Publication Data

US 2004/0216891 A1 Nov. 4, 2004

Related U.S. Application Data

(63) Continuation-in-part of application No. 10/428,163, filed on May 1, 2003.

(51) Int. Cl.
*E21B 23/00* (2006.01)
*E21B 29/00* (2006.01)

(52) U.S. Cl. ..... 166/382; 166/208; 166/242.6; 166/277

(58) Field of Classification Search ..... 166/277, 166/381, 382, 384, 387, 380, 297, 298, 55, 166/55.1, 206, 207, 208, 212, 216, 217, 242.6
See application file for complete search history.

(56) References Cited

U.S. PATENT DOCUMENTS

| | | | | |
|---|---|---|---|---|
| 4,523,641 | A * | 6/1985 | Manderscheid | 166/208 |
| 5,366,012 | A * | 11/1994 | Lohbeck | 166/277 |
| 5,620,052 | A * | 4/1997 | Turner | 166/348 |
| 6,012,523 | A * | 1/2000 | Campbell et al. | 166/277 |
| 6,425,444 | B1 * | 7/2002 | Metcalfe et al. | 166/387 |
| 6,446,724 | B1 | 9/2002 | Baugh et al. | 166/285 |
| 6,454,493 | B1 * | 9/2002 | Lohbeck | 405/184.2 |
| 6,457,532 | B1 | 10/2002 | Simpson | 166/380 |
| 6,598,678 | B1 * | 7/2003 | Simpson et al. | 166/297 |
| 6,631,765 | B1 * | 10/2003 | Baugh et al. | 166/285 |
| 6,648,075 | B1 | 11/2003 | Badrak et al. | 166/381 |
| 6,662,876 | B1 * | 12/2003 | Lauritzen | 166/380 |
| 6,666,276 | B1 * | 12/2003 | Yokley et al. | 166/387 |
| 6,688,397 | B1 * | 2/2004 | McClurkin et al. | 166/380 |
| 6,688,399 | B1 * | 2/2004 | Maguire et al. | 166/382 |
| 6,691,789 | B1 * | 2/2004 | Jackson et al. | 166/384 |
| 6,702,029 | B1 * | 3/2004 | Metcalfe et al. | 166/378 |

(Continued)

FOREIGN PATENT DOCUMENTS

| | | |
|---|---|---|
| GB | 2 345 308 | 7/2000 |

(Continued)

OTHER PUBLICATIONS

U.K. Search Report, Application No. GB 0409684.8, dated Aug. 6, 2004.

*Primary Examiner*—Jennifer H. Gay
(74) *Attorney, Agent, or Firm*—Patterson & Sheridan, L.L.P

(57) ABSTRACT

An apparatus for forming an expanded connection in a wellbore, whereby the apparatus includes a first tubular radially expandable outward into contact with an inner wall of a second tubular upon the application of an outwardly directed force supplied to an inner surface of the first tubular. The apparatus further includes a plurality of outwardly extending formations formed on an outer surface of the first tubular, the formations constructed and arranged to provide a frictional relationship between the first tubular and the second tubular while leaving a fluid path when the first tubular is expanded to engage the inner wall of the second tubular.

46 Claims, 17 Drawing Sheets

U.S. PATENT DOCUMENTS

| | | | | |
|---|---|---|---|---|
| 6,722,427 | B1 * | 4/2004 | Gano et al. | 166/217 |
| 6,722,441 | B1 * | 4/2004 | Lauritzen et al. | 166/380 |
| 2001/0020532 | A1 * | 9/2001 | Baugh et al. | 166/285 |
| 2002/0060079 | A1 * | 5/2002 | Metcalfe et al. | 166/387 |
| 2002/0139540 | A1 * | 10/2002 | Lauritzen | 166/387 |
| 2002/0166668 | A1 * | 11/2002 | Metcalfe et al. | 166/378 |
| 2003/0042022 | A1 | 3/2003 | Lauritzen et al. | |
| 2003/0047320 | A1 * | 3/2003 | Badrak et al. | 166/380 |
| 2003/0047322 | A1 * | 3/2003 | Maguire et al. | 166/380 |
| 2003/0047323 | A1 * | 3/2003 | Jackson et al. | 166/380 |
| 2003/0056948 | A1 * | 3/2003 | Cameron | 166/206 |
| 2003/0062171 | A1 | 4/2003 | Maguire et al. | |
| 2003/0098164 | A1 * | 5/2003 | Hirth | 166/382 |
| 2003/0106698 | A1 * | 6/2003 | Simpson et al. | 166/382 |
| 2003/0111234 | A1 * | 6/2003 | McClurkin et al. | 166/384 |
| 2003/0131997 | A1 * | 7/2003 | Chatterji et al. | 166/278 |
| 2003/0188868 | A1 * | 10/2003 | Simpson et al. | 166/298 |
| 2004/0099423 | A1 * | 5/2004 | Badrak et al. | 166/380 |
| 2004/0177953 | A1 * | 9/2004 | Wubben | 166/207 |
| 2004/0216891 | A1 * | 11/2004 | Maguire | 166/380 |
| 2004/0216893 | A1 * | 11/2004 | Hirth | 166/382 |
| 2004/0251033 | A1 * | 12/2004 | Cameron et al. | 166/382 |
| 2004/0256098 | A1 * | 12/2004 | Ducasse et al. | 166/207 |

FOREIGN PATENT DOCUMENTS

| | | |
|---|---|---|
| WO | WO 02/038343 | 5/2002 |
| WO | WO 03/006790 | 1/2003 |

* cited by examiner

EXPANDABLE HANGER WITH COMPLIANT SLIP SYSTEM

CROSS-REFERENCE TO RELATED APPLICATIONS

This application is a continuation-in-part of co-pending U.S. patent application Ser. No. 10/428,163, entitled SOLID EXPANDABLE HANGER WITH COMPLIANT SLIP SYSTEM, filed on May 1, 2003, which patent application is herein incorporated by reference.

BACKGROUND OF THE INVENTION

1. Field of the Invention

The present invention relates to wellbore completion. More particularly, the invention relates to an apparatus and method for creating an attachment and a seal between two tubulars in a wellbore.

2. Description of the Related Art

In the drilling of oil and gas wells, a wellbore is formed using a drill bit that is urged downwardly at a lower end of a drill string. After drilling a predetermined depth, the drill string and bit are removed, and the wellbore is lined with a string of steel pipe called casing. The casing provides support to the wellbore and facilitates the isolation of certain areas of the wellbore adjacent hydrocarbon bearing formations. The casing typically extends down the wellbore from the surface of the well to a designated depth. An annular area is thus defined between the outside of the casing and the earth formation. This annular area is filled with cement to permanently set the casing in the wellbore and to facilitate the isolation of production zones and fluids at different depths within the wellbore.

It is common to employ more than one string of casing in a wellbore. In this respect, a first string of casing is set in the wellbore when the well is drilled to a first designated depth. The well is then drilled to a second designated depth and a second string of casing or liner is run into the well to a depth whereby the upper portion of the second liner is overlapping the lower portion of the first string of casing. The second liner string is then fixed or hung in the wellbore usually by some mechanical slip mechanism well known in the art and cemented. This process is typically repeated with additional casing strings until the well has been drilled to total depth.

A recent trend in well completion has been the advent of expandable tubular technology. It has been discovered that both slotted and solid tubulars can be expanded in situ so as to enlarge the inner diameter. This, in turn, enlarges the path through which both fluid and downhole tools may travel. Also, expansion technology enables a smaller tubular to be run into a larger tubular and then expanded so that a portion of the smaller tubular is in contact with the larger tubular therearound. Tubulars are expanded by the use of a cone-shaped mandrel or by a rotary expansion tool with extendable, fluid actuated members disposed on a body and run into the wellbore on a tubular string. An exemplary rotary expansion tool is described in U.S. Pat. No. 6,457,532, issued to Simpson on Oct. 1, 2002, which is herein incorporated by reference in its entirety. During expansion of a tubular, the tubular walls are expanded past their elastic limit. The use of expandable tubulars as liner hangers and packers allows for the use of larger diameter production tubing because the conventional slip mechanism and sealing mechanism are eliminated.

If the liner hanger is expanded by a cone-shaped mandrel, then a forgiving material like an elastomer is typically employed between the outer diameter of the liner hanger and the inner diameter of the larger tubular to accommodate any variances in the inner diameter of the larger tubular. In this particular prior art embodiment, it is this forgiving material that provides the mechanism for hanging the weight of the liner below the liner hanger. Typically, the forgiving material is made from a nitrile rubber compound or a similar material with compliant properties.

When using an expandable liner hanger, it is usually desirable to expand the liner hanger to support the weight of a liner and then release the running tool from the liner prior to cementing the liner in place. Typically, the use of the cone-shaped mandrel requires that circulation ports be cut in the wall of the liner directly below the liner hanger section to provide a fluid path for circulating fluid and cement during the cementing process. Then following the cementing process, these ports must be isolated typically by expanding another elastomer clad section below the ports.

Expanding liner hangers with a cone-shaped mandrel in a wellbore offers obvious advantages over other technology. However, there are problems associated with using the expandable technology. For example, by using a forgiving material, such as a nitrile rubber compound, the liner hanging mechanism may only be effectively utilized in a wellbore that has a temperature of less 250° F. If the liner hanger is used in a higher temperature wellbore, then the rubber's ability to carry a load drops off dramatically due to the mechanical properties of the material. More importantly, the circulating ports that are cut into the wall of the liner below the liner hanger diminish the carrying capacity of the hanger due to a reduction of material through this section therefore limiting the length of the liner.

A need therefore exists for an expandable hanger that provides for a cement bypass without compromising the carrying capacity of the hanger. There is a further need for an expandable hanger that is capable of enduring a high temperature installation that provides compliant properties to ensure constant contact between the expandable hanger and the casing therearound. Furthermore, there is a need for an improved expandable liner hanger with a means for circulating fluids therearound. There is yet a further need for an improved expander tool for expanding tubulars.

SUMMARY OF THE INVENTION

The present invention generally relates to an apparatus and method for engaging a first tubular and a second tubular in a wellbore. In one aspect, an apparatus for forming an expanded connection in a wellbore is provided. The apparatus includes a first tubular radially expandable outward into contact with an inner wall of a second tubular upon the application of an outwardly directed force supplied to an inner surface of the first tubular. The apparatus further includes a plurality of outwardly extending formations formed on an outer surface of the first tubular, the formations constructed and arranged to provide a frictional relationship between the first tubular and the second tubular while leaving a fluid path when the first tubular is expanded to engage the inner wall of the second tubular.

In another aspect, a method of compliantly expanding a tubular into contact with a casing wall is provided. The method includes placing the tubular at a predefined location within the casing, the tubular having at least two outwardly extending, substantially longitudinal formations formed on an outer surface thereof. The method further includes passing an expander tool through an inside diameter of the tubular to expand its outer diameter, the expander tool having at least two substantially longitudinal ribs formed on an outer surface thereof, the expander tool centered within the tubular in a manner whereby the ribs are misaligned with the formation providing a compliant force between the formation and the casing wall.

In a further aspect, an expandable apparatus for expanding a tubular is provided. The expandable apparatus includes an upper member having a tapered portion on an outer surface thereof and a lower member having an oppositely tapered portion on an outer surface thereof, whereby the tapered portions are movable towards each other. The expandable apparatus further includes a plurality of pads disposed between the tapered portions, the pads extendable outwards to increase an outer diameter of the apparatus when the tapered portions are moved toward each other.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention generally relates to a method and an apparatus for forming an expandable hanger connection with a surrounding casing. In one aspect, an expandable hanger with compliant slip system is disclosed. Typically, a liner assembly including a liner hanger is disposed in a wellbore proximate the lower end of the surrounding casing. Next, an expander tool is urged axially through the liner hanger to radially expand the hanger into frictional contact with the surrounding casing and to form a plurality of cement bypass ports. Thereafter, cement is circulated through the wellbore and eventually through the plurality of cement bypass ports to cement the liner assembly within the wellbore. Subsequently, a liner seal is radially expanded to seal off the plurality of cement bypass ports. It should be noted, however, that the expandable hanger with compliant slip system may be used with any expandable tubular, such as a slotted tubular or a screen. In another aspect, a collapsible expander tool for use with the expandable hanger with compliant slip system is disclosed. Generally, the collapsible expander tool includes two opposing cones with a plurality of pads spaced radially around the circumference of the tool. During activation of the collapsible expander tool, the cones converge thereby extending the pads radially outward. Thereafter, the activated expander tool may be employed to radially expand the expandable hanger.

Figure 1:
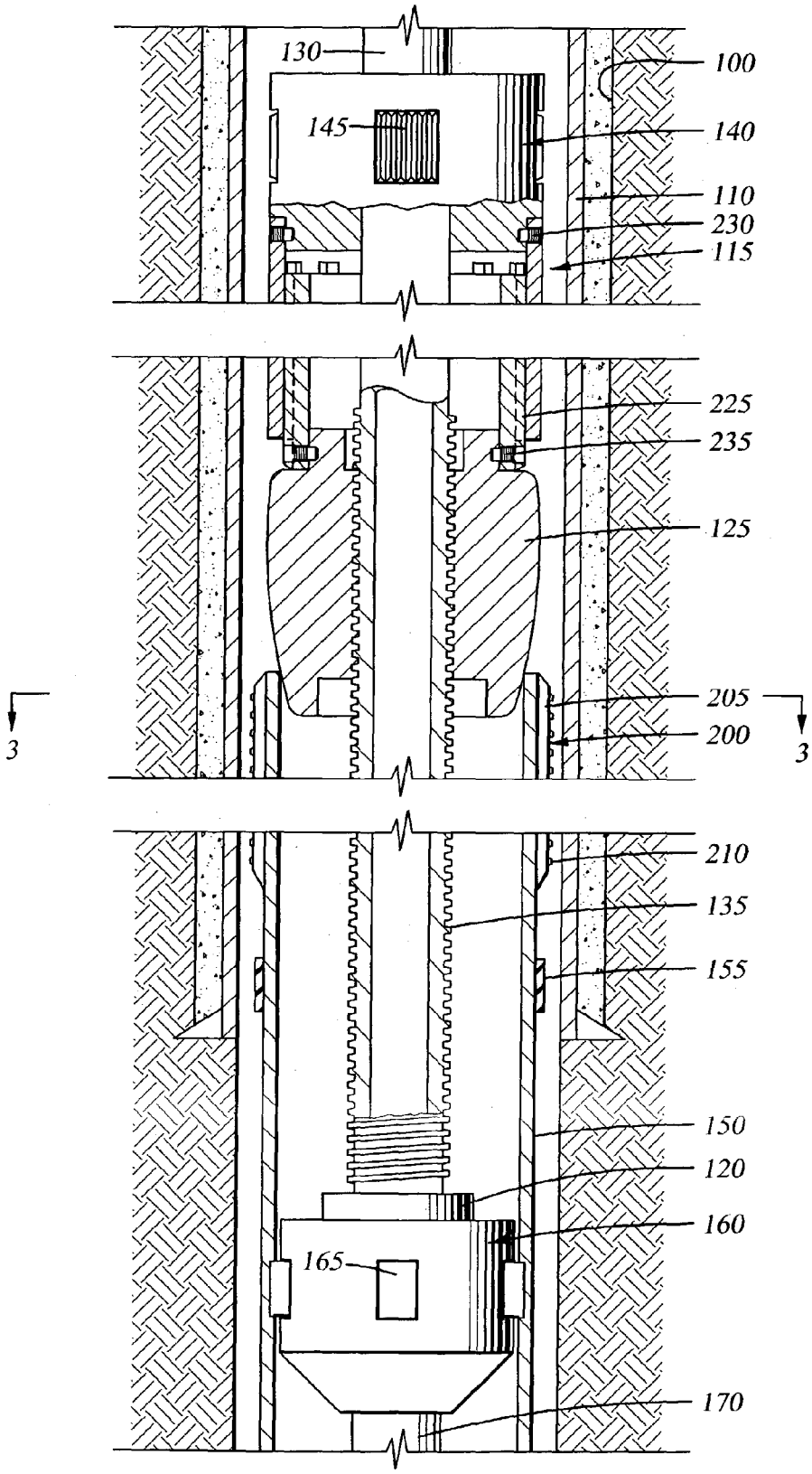
FIG. 1 is a cross-sectional view illustrating an expandable hanger with compliant slip system of the present invention in a run-in position.

FIG. 1 is a cross-sectional view illustrating an expandable hanger 200 of the present invention in a run-in position. At the stage of completion shown in FIG. 1, a wellbore 100 has been lined with a string of casing 110. Thereafter, a subsequent liner assembly 150 is positioned proximate the lower end of the casing 110. Typically, the liner assembly 150 is lowered into the wellbore 100 by a running tool 115 disposed at the lower end of a working string 130.

At the upper end of the running tool 115 is an upper torque anchor 140. Preferably, the torque anchor 140 defines a set of slip members 145 disposed radially around the torque anchor 140. In the embodiment of FIG. 1, the slip members 145 define at least two radially extendable pads with surfaces having gripping formations like teeth formed thereon to prevent rotational movement. As illustrated, the torque anchor 140 is in its recessed position, meaning that the pads 145 are substantially within the plane of the casing 110. In other words, the pads 145 are not in contact with the casing 110 so as to facilitate the run-in of the liner assembly 150. The pads 145 are selectively actuated either hydraulically or mechanically or combinations thereof as known in the art.

A spline assembly 225 is secured at one end to the torque anchor 140 by a plurality of upper torque screws 230 and secured at the other end to an axially movable expander tool 125 by a plurality of lower torque screws 235. As used herein, a spline assembly means a mechanical torque connection between a first and second member. Typically, the first member includes a plurality of keys and the second member includes a plurality of keyways. When rotational torque is applied to the first member, the keys act on the keyways to transmit the torque to the second member. Additionally, the spline assembly permits axial movement between the first and second member while maintaining the torque connection. In this respect, the torque anchor 140 maintains the expander tool 125 rotationally stationary while permitting the expander tool 125 to move axially.

The axially movable expander tool 125 is disposed on a threaded mandrel 135. Expander tools are well known in the art and are generally used to radially enlarge an expandable tubular by urging the expander tool axially through the tubular, thereby swaging the tubular wall radially outward as the larger diameter tool is forced through the smaller diameter tubular member. In the embodiment shown, the expander tool 125 includes female threads formed on an inner surface thereof that mate with male threads formed on the threaded mandrel 135. As the threaded mandrel 135 is rotated, the expander tool 125 moves axially through the hanger 200 to expand it outward in contact with the casing 110. It is to be understood, however, that other means may be employed to urge the expander tool 125 through the hanger 200 such as hydraulics or any other means known in the art. Furthermore, the expander tool 125 may be disposed in the hanger 200 in any orientation, such as in a downward orientation as shown for a top down expansion or in an upward orientation for a bottom up expansion. Additionally, an expandable tool may be employed. Preferably, the expandable tool moves between a first smaller diameter and a second larger diameter, thereby allowing for both a top down expansion and a bottom up expansion depending on the directional axial movement of the expandable tool.

Disposed below the threaded mandrel 135 is a swivel 120. Generally, the swivel 120 permits the relative rotation of a threaded mandrel 135 while the supporting torque anchor 140 and the hanger 200 remain rotationally stationary. A lower anchor 160 with extendable members 165 is located below the swivel 120.

As shown in FIG. 1, the lower anchor 160 is in its extended position, meaning that the extendable members 165 are in contact with the inner surface of the liner assembly 150 so as to secure the liner assembly 150 to the running tool 115. The extendable members 165 are selectively actuated either hydraulically or mechanically or both as known in the art. Furthermore, a fluid outlet 170 is provided at the lower end of the lower anchor 160. The fluid outlet 170 serves as a fluid conduit for cement or other drilling fluid to be circulated into the wellbore 100 in accordance with the method of the present invention.

The liner assembly 150 includes the expandable hanger 200 of this present invention. The expandable hanger 200 comprises of a plurality of formations that are illustrated as a plurality of ribs 205 formed on the outer surface of the hanger 200. The plurality of ribs 205 are circumferentially spaced around the hanger 200 to provide support for the liner assembly 150 upon expansion of the hanger 200. As illustrated, a plurality of inserts 210 are disposed on the ribs 205. The inserts 210 provide a gripping means between the outer surface of the hanger 200 and the inner surface of the casing 110 within which the liner assembly 150 is coaxially disposed. The inserts 210 are made of a suitably hardened material and are attached to the outer surface of the ribs 205 of the hanger 200 through a suitable means such as soldering, epoxying, or other adhesive methods, or via threaded connection. In the preferred embodiment, inserts 210 are press-fitted into preformed apertures in the outer surface of the ribs 205 of the hanger 200. After expansion, the inserts 210 are engaged with the inner surface of the surrounding casing 110, thereby increasing the ability of the expanded hanger 200 to support the weight of the liner assembly 150 below the expanded portion.

In the preferred embodiment, the inserts 210 are fabricated from a tungsten carbide material. However, another fabrication material may be employed, so long as the material has the capability of gripping the inner surface of the casing 110 during expansion of the hanger 200. Examples of fabrication materials for the inserts 210 include ceramic materials (such as carbide) and hardened metal alloy materials. The carbide inserts 210 define raised members fabricated into the hanger 200. However, other embodiments of gripping means may alternatively be employed. Such means include, but are not limited to, buttons having teeth (not shown), or other raised or serrated members on the outer surface of the ribs 205 of the hanger 200. The gripping means may also include a plurality of long inserts defined on the outside diameter of the hanger 200, thus creating a plurality of flutes (not shown) between the plurality of long inserts. Alternatively, the gripping means may define a plurality of hardened tooth patterns added to the outer surface of the ribs 205 of the hanger 200.

In the embodiment shown in FIG. 1, the liner assembly 150 includes a liner seal 155 disposed below the expandable hanger 200. The primary purpose of the liner seal 155 is to seal off the expandable hanger 200 after a cementation operation is complete, as will be discussed in a subsequent paragraph. Generally, the liner seal 155 creates a fluid seal between the liner assembly 150 and the casing 110 upon expansion of the liner seal 155. In the preferred embodiment, the liner seal 155 is fabricated from an elastomeric material. However, other material may be employed that is capable of creating the fluid seal sought to be obtained between the expanded portion of the liner assembly 150 and the casing 110. Typically, the liner seal 155 is disposed around the liner assembly 150 by a thermal process or some other well known means.

Although the liner assembly 150 in FIG. 1 shows only one liner seal 155 disposed below the expandable hanger 200, the invention is not limited to this particular location or the quantity illustrated. For instance, any number of liner seals may be employed with the expandable hanger 200 of the present invention and the liner seals may be placed in any location adjacent the expandable hanger 200 to create a fluid seal between the liner assembly 150 and the casing 110. For example, the liner seal 155 may be employed above the expandable hanger 200 or both above and below the expandable hanger 200 to form a fluid seal between the liner assembly 150 and the casing 110.

Figure 2:
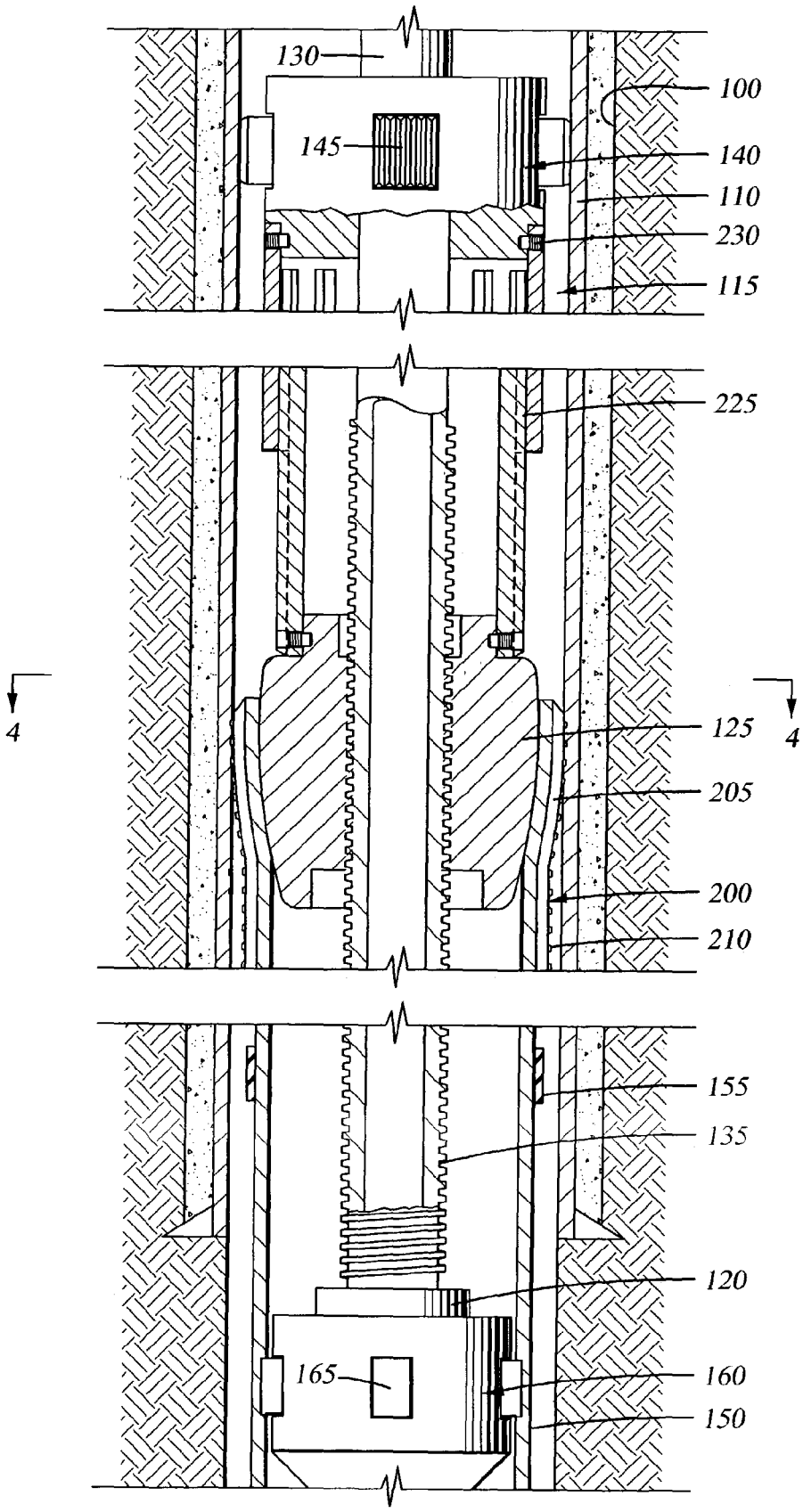
FIG. 2 is a cross-sectional view illustrating an expander tool partially expanding the expandable hanger.

FIG. 2 is a cross-sectional view illustrating the expander tool 125 partially expanding the expandable hanger 200. As shown, the liner assembly 150 is positioned proximate the lower end of the casing 110. Thereafter, the upper torque anchor 140 is actuated, thereby extending the pads 145 radially outward into contact with the surrounding casing 110. Subsequently, rotational force is transmitted through the working string 130 to the threaded mandrel 135. The swivel 120 permits the threaded mandrel 135 to rotate in a first direction while the torque anchor 140, the spline assembly 225, expander tool 125, and liner assembly 150 remain rotationally stationary. As the threaded mandrel 135 rotates, the expander tool 125 moves axially in a first direction through the expandable hanger 200 causing the hanger 200 to expand radially outward forcing the inserts 210 to contact the inner surface of the casing 110 as illustrated. The expander tool 125 continues to expand the entire length of the expandable hanger 200 until it reaches a predetermined point above the liner seal 155. At that point, the expansion is stopped to prevent expanding the liner seal 155, in anticipation of cementing.

Figure 3:
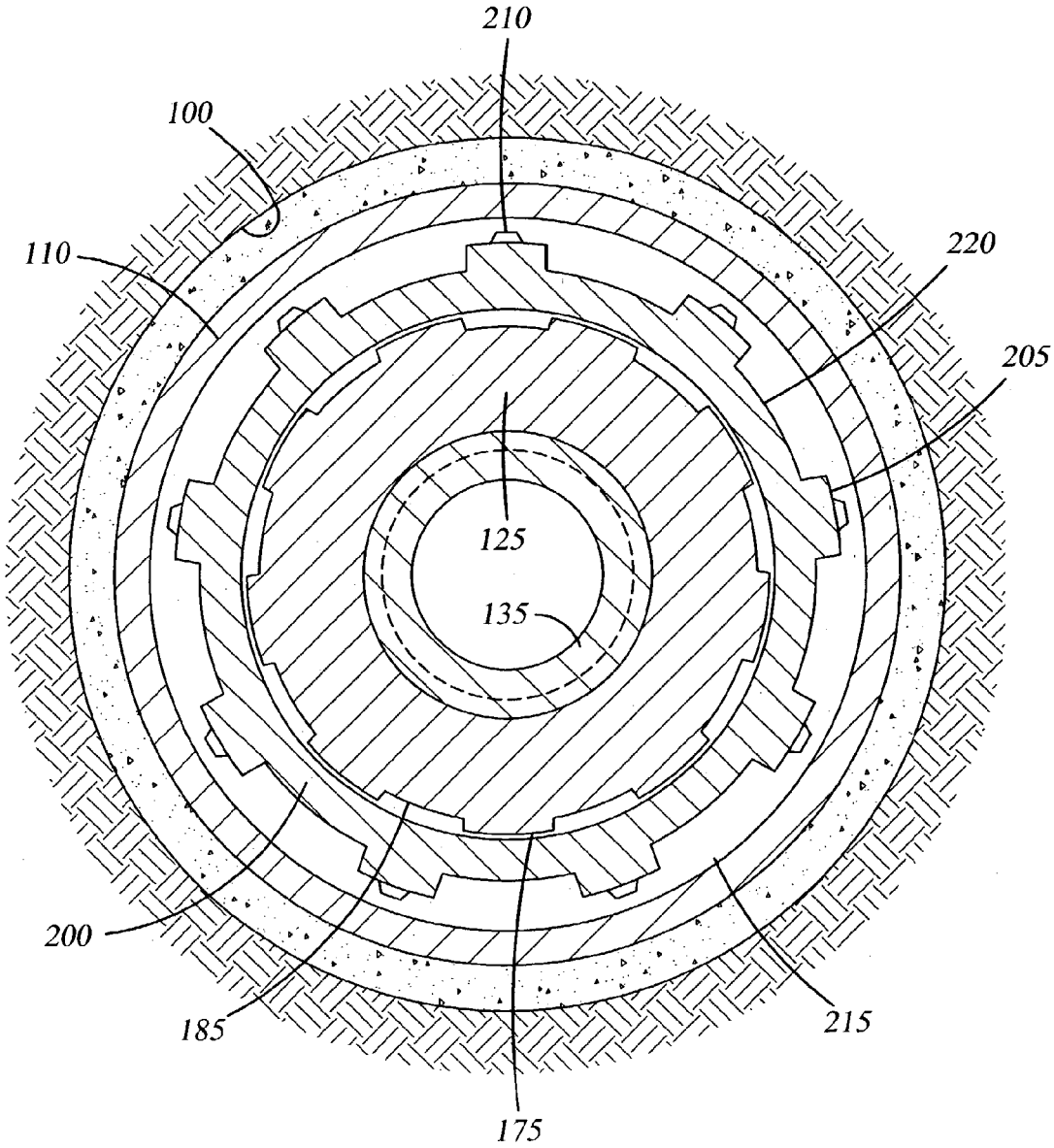
FIG. 3 is a cross-sectional view taken along line 3—3 of FIG. 1 illustrating the expander tool in the expandable hanger prior to expansion.

FIG. 3 is a cross-sectional view taken along line 3—3 in FIG. 1 to illustrate the orientation of the expander tool 125 in the expandable hanger 200. As clearly shown, the expander tool 125 includes a plurality of formations illustrated as a plurality of expander ribs 175 and a plurality of expander flutes 185 circumferentially spaced around the expander tool 125. The plurality of expander ribs 175 are generally tapered members defining a first outer diameter at a first location smaller than a second outer diameter at a second location. Also clearly shown, the hanger 200 includes a plurality of hanger flutes 220 disposed between the plurality of ribs 205.

Figure 4:
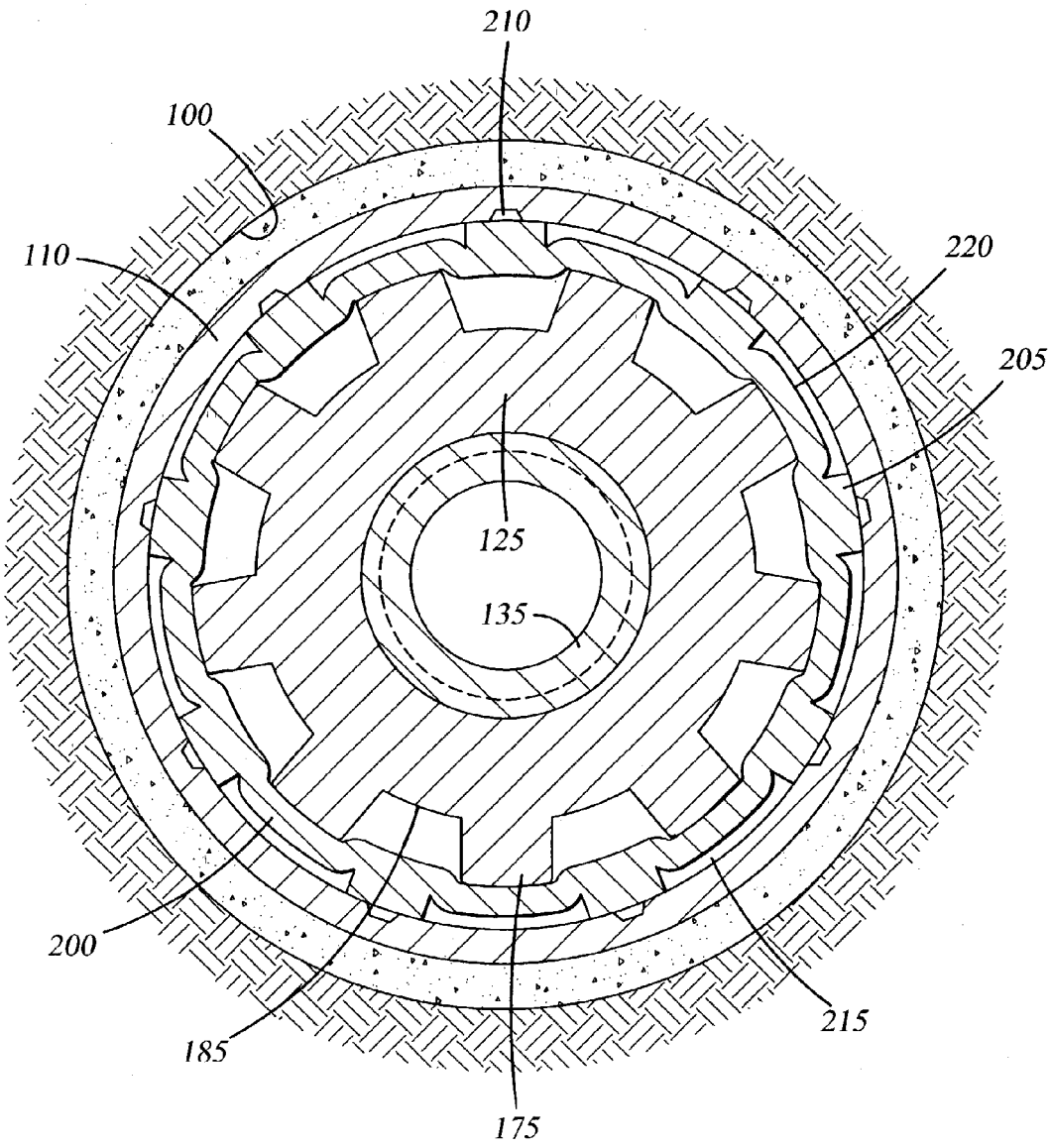
FIG. 4 is a cross-sectional view taken along line 4—4 of FIG. 2 illustrating the expander tool during the expansion of the expandable hanger.

FIG. 4 is a cross-sectional view taken along line 4—4 of FIG. 2 illustrating the expander tool 125 during the expansion of the expandable hanger 200. The expander tool 125 is oriented in the expandable hanger 200 by aligning the plurality flutes 185 with the plurality of ribs 205. Therefore, as the expander tool 125 moves axially through the hanger 200, the ribs 175 apply a force on the hanger flutes 220, causing them to expand out radially, which in turn urges the ribs 205 on the hanger 200 out radially as the inserts 210 penetrate the surrounding casing 110. At this point the hanger flutes 220 are free to move out radially while the radially stationary ribs 205 are accommodated by the flutes 185. In other words, the expandable hanger 200 includes a compliant slip system that allows the hanger ribs 205 to conform to the surrounding casing 110 as the expander tool 125 urges the expandable hanger 200 radially outward. Given that the radial extension of the hanger flutes 220 are dictated by the diameter of the ribs 175, they never contact the surrounding casing 110. In this manner, the cement bypass ports 215 are formed thereby providing a fluid passageway between the hanger 200 and the surrounding casing 110 during the cementing operation.

Figure 5:
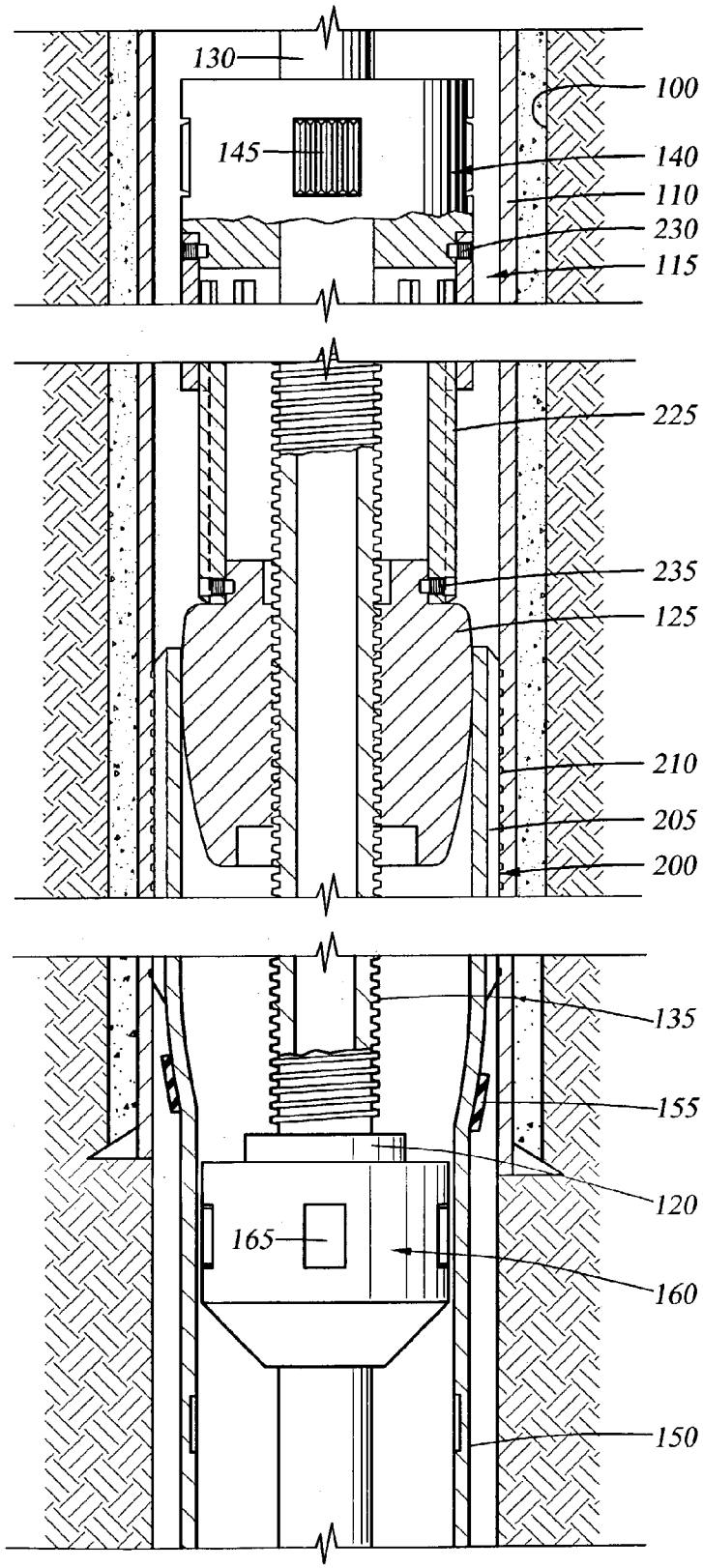
FIG. 5 is a cross-sectional view illustrating the release of the running tool prior to a cementing operation.

FIG. 5 is a cross-sectional view illustrating the release of the running tool 115 prior to a cementing operation. It is desirable to release the running tool 115 from the liner assembly 150 prior to cementing it in the wellbore 100 to prevent the foreseeable difficulty of releasing the tool 115 after the cementation operation. As shown, the torque anchor 140 is also in its recessed position, meaning that the pads 145 have been retracted and are no longer in contact with the casing 110. Furthermore, the hanger 200 supports the weight of the liner assembly 150 therefore the lower anchor 160 is deactivated, meaning that the extendable members 165 have been retracted and are no longer in contact with the inner surface of the liner assembly 150 so as to release the liner assembly 150 from the running tool 115.

Figure 6:
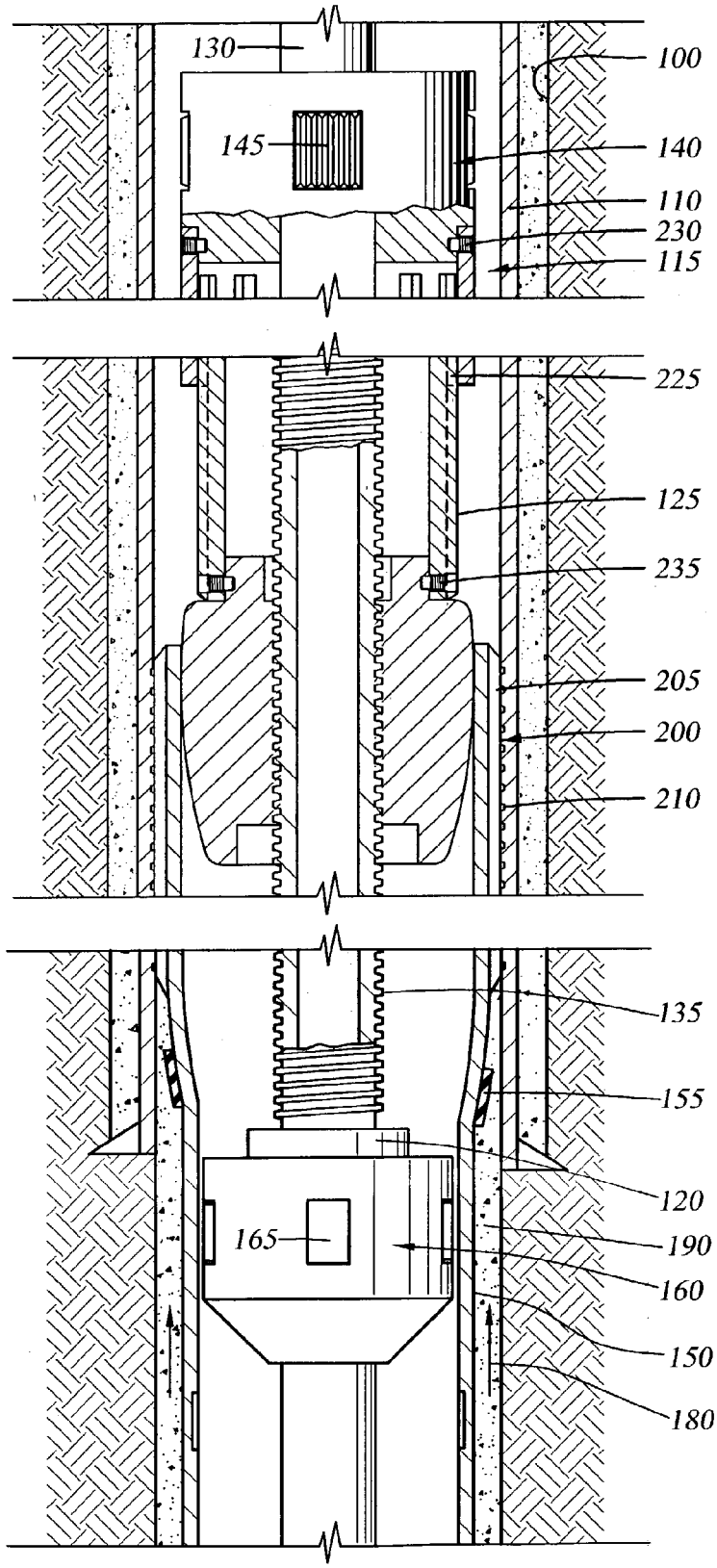
FIG. 6 is a cross-sectional view illustrating the cementation of the liner assembly within the wellbore.

FIG. 6 is a cross-sectional view illustrating the cementation of the liner assembly 150 within the wellbore 100. Preferably, cement is pumped through the working string 130, the running tool 115, and the fluid outlet 170 to a cement shoe (not shown) or another means known in the art to distribute the cement. As indicated by arrow 180, the cement is circulated up an annulus 190 formed between the liner assembly 150 and the wellbore 100 and past the liner seal 155 into the cement bypass ports (not shown) of the expandable hanger 200. Thereafter, the cement flows through the bypass ports and exits into the inner diameter of the surrounding casing 110.

Figure 7:
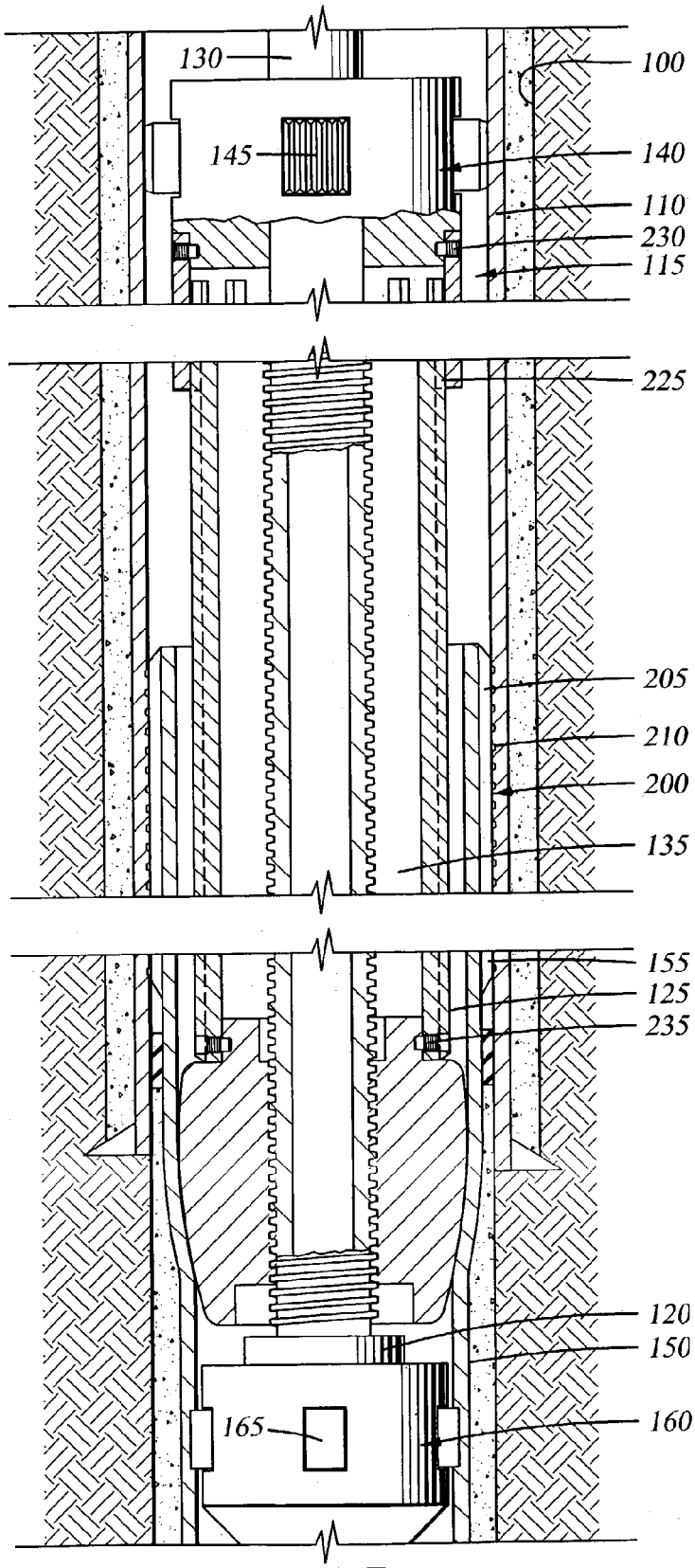
FIG. 7 is a cross-sectional view illustrating the expansion of the liner seal after the cementing operation.

FIG. 7 is a cross-sectional view illustrating the expansion of the liner seal 155 after the cementing operation. As shown, the liner assembly 150 has been completely cemented in the wellbore 100. As further shown, the torque anchor 140 and lower anchor 160 are once again actuated, thereby extending the pads 145 radially outward into contact with the surrounding casing 110. Subsequently, rotational force is transmitted through the working string 130 to the threaded mandrel 135. The swivel 120 permits the threaded mandrel 135 to rotate in the first direction while the supporting torque anchor 140, the spline assembly 225, and the expander tool 125 remain rotationally stationary. As the threaded mandrel 135 rotates in the first direction, the expander tool 125 moves axially in the first direction through the expanded portion of the hanger 200 to a predetermined location above the liner seal 155.

Thereafter, a plurality of selectively extendable elements (not shown) are activated. Referring to FIG. 4, the plurality of selectively extendable elements are preferably disposed in the plurality of expander flutes 185. The plurality of extendable elements are constructed and arranged to extend radially outward to substantially fill in the expander flutes 185 which results in an expander tool with a substantially uniform outer diameter capable of expanding the entire outer perimeter of the liner seal 155. The extendable elements may be a selectively movable piston, an extendable dog assembly, a collet assembly, or any other suitable member to fill the plurality of expander flutes 185.

Referring back to FIG. 7, the expander tool 125 with the activated extendable elements moves axially through the liner seal 155, thereby expanding the entire perimeter of the liner seal 155 radially outward forcing the elastomeric material to form a fluid seal between the liner assembly 150 and the surrounding casing 110. Alternatively, a rotary expansion tool with extendable members (not shown) or a cone shaped mandrel (not shown) may be employed to expand the liner seal 155. Additionally, the expander tool 125 could be rotated to expand the liner seal 155. In either case, the cement bypass ports (not shown) are sealed off to prevent any further migration of fluid through the expandable hanger 200 from micro-annuluses that may have formed during the cementing operation.

Figure 8:
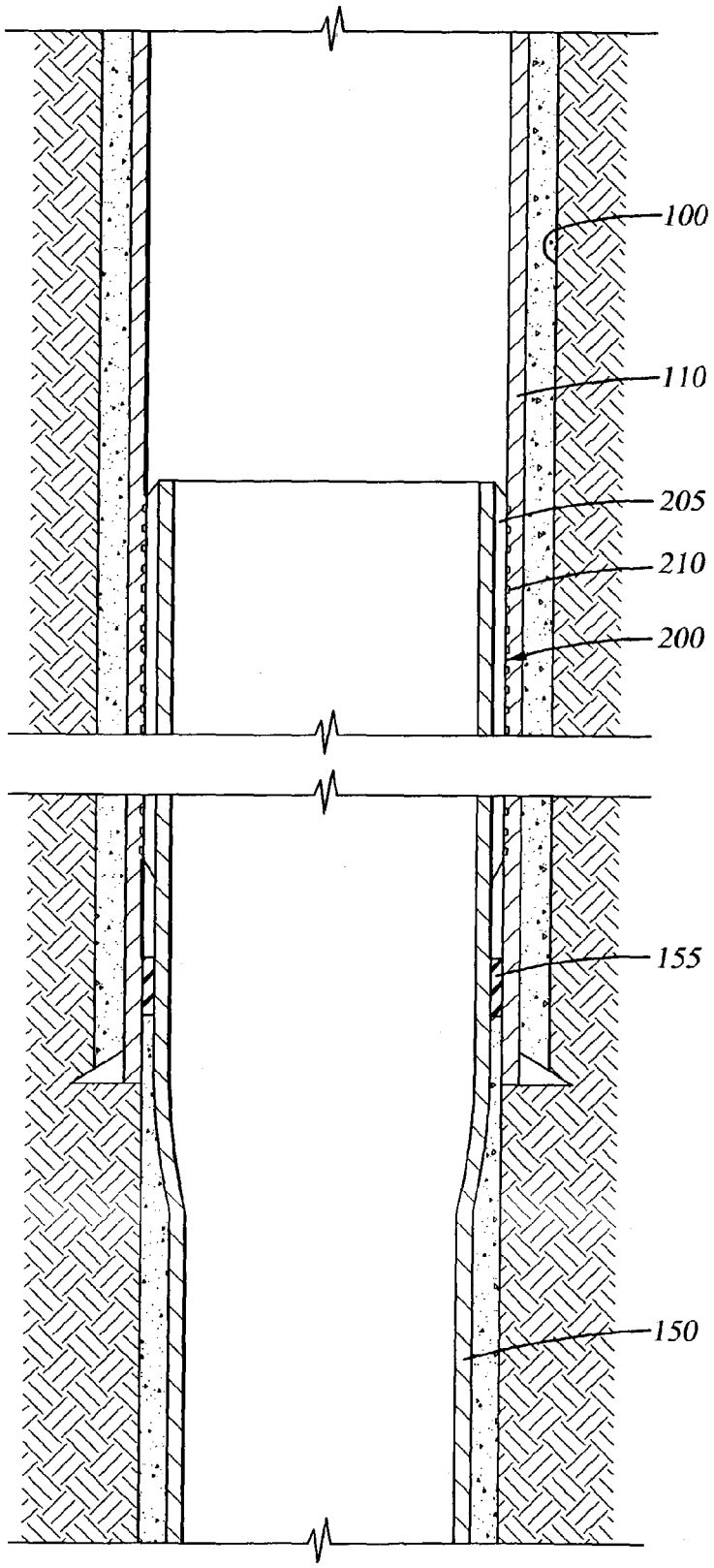
FIG. 8 is a cross-sectional view illustrating the fully expanded expandable hanger after the running tool has been removed.

FIG. 8 is a cross-sectional view illustrating the fully expanded expandable hanger 200 after the running tool 115 has been removed. As shown, the expandable hanger 200 is fully engaged with the lower portion of the surrounding casing 110 and consequently supporting the entire weight of the liner assembly 150 by way of the inserts 210 on the hanger ribs 205. As further shown, the liner seal 155 has been expanded radially outward and is therefore creating the lower fluid seal between the liner assembly 150 and the surrounding casing 110.

Creating an attachment and a seal between two tubulars in a wellbore can be accomplished with methods that use embodiments of the expandable hanger as described above. A method of completing a wellbore includes placing a first tubular coaxially within a portion of a second tubular, the first tubular including a plurality of formations on an outer surface thereof to provide a frictional relationship between the first tubular and the second tubular while leaving a fluid path through the expanded connection. The method also includes positioning an expander tool within the first tubular at a depth proximate the plurality of formations on the first tubular. The method further includes urging the expander tool axially through the first tubular to expand the first tubular into frictional contact with the second tubular and forming a fluid path through an overlapped portion between the first and second tubulars. Therefore, the apparatus and methods disclosed herein for using embodiments of the expandable hanger permits the connection of two tubulars within a wellbore.

In another aspect, a collapsible expander tool for use with the expandable hanger with compliant slip system is disclosed. It should be noted, however, that the collapsible expander tool may be employed with other expandable tubulars, such as expandable screens and expandable casing.

Figure 9:
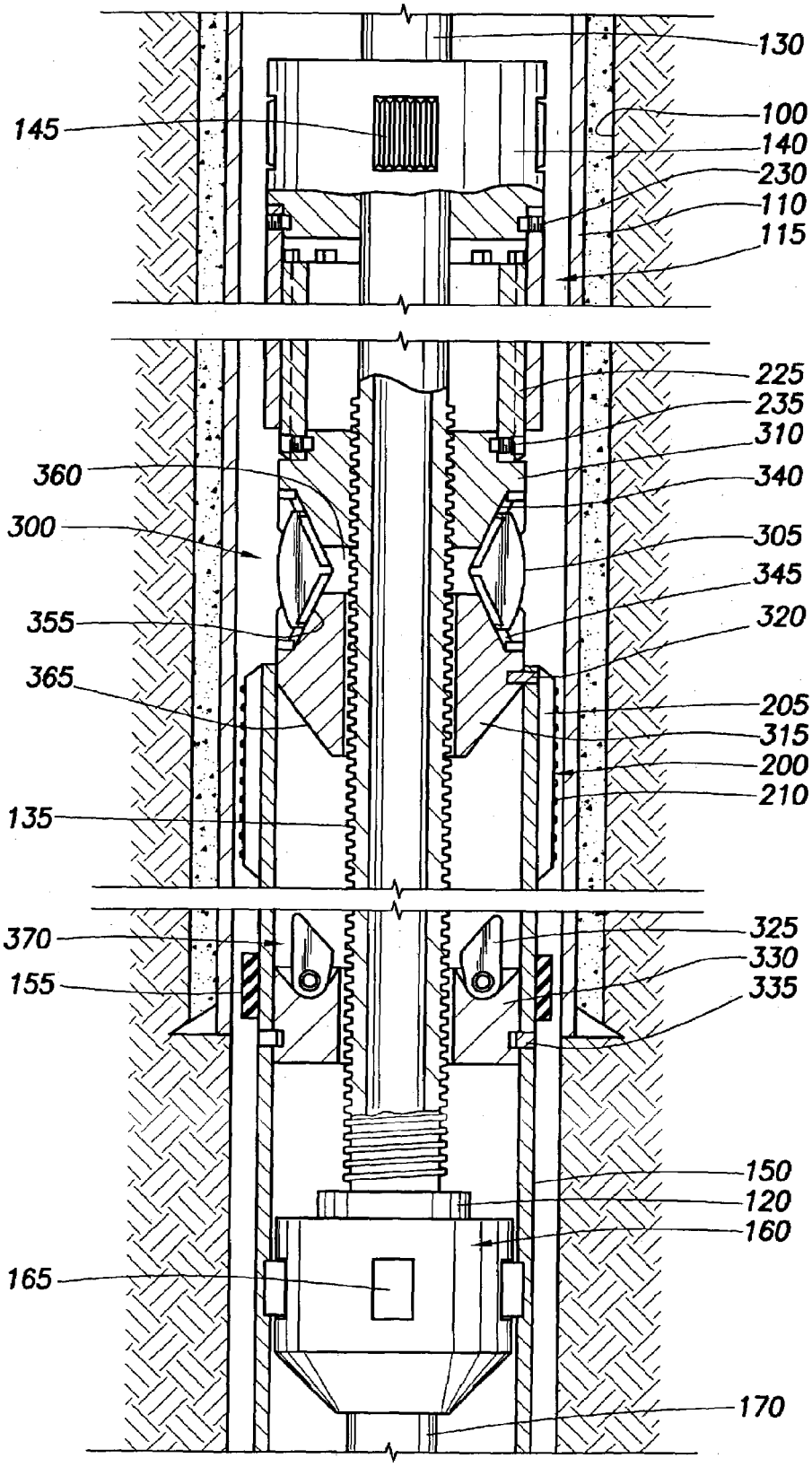
FIG. 9 is a cross-sectional view illustrating a collapsible expander tool in the expandable hanger with compliant slip system.

FIG. 9 is a cross-sectional view illustrating a collapsible expander tool in the expandable hanger 200 with compliant slip system. For convenience, the components in FIGS. 9–17 that are similar to the components as described in FIGS. 1–8 will be labeled with the same numbers. As discussed in a previous paragraph, a liner assembly 150 is lowered into the wellbore 100 by a running tool 115 disposed at the lower end of a working string 130.

As shown in FIG. 9, the collapsible expander tool 300 is in a collapsed run-in position. The upper end of the collapsible expander tool 300 is secured to a spline assembly 225 by a plurality of lower torque screws 235 while the lower end of the collapsible expander tool 300 is temporarily attached to the liner assembly 150 by a plurality of shear pins 320. Additionally, the collapsible expander tool 300 is disposed on a threaded mandrel 135. Preferably, the expander tool 300 includes female threads formed on an inner surface thereof that mate with male threads formed on the threaded mandrel 135. Generally, the rotation of the threaded mandrel 135 activates the expander tool 300 and moves it axially through the hanger 200. It is to be understood, however, that other means may be employed to urge the expander tool 300 through the hanger 200, such as hydraulics, mechanical manipulation, or combinations thereof as known in the art. Furthermore, the expander tool 300 may be disposed in the hanger 200 in any orientation, such as in a downward orientation as shown for a top down expansion, an upward orientation for a bottom up expansion, or placed in the middle of the hanger 200 for expansion in either direction.

As illustrated in FIG. 9, the collapsible expander tool 300 includes an upper cone 310 and a lower cone 315. The cones 310, 315 are spaced apart to form a gap 360 therebetween. The upper cone 310 includes a tapered portion 340 disposed adjacent a first tapered portion 345 on the lower cone 315 to form a profile. The lower cone 315 further includes a second tapered portion 365 formed at the lower end thereof. The collapsible expander tool 300 further includes a plurality of selectively extendable members, such as a plurality of pads 305 spaced radially around the expander tool 300. The inner portion of the pads 305 includes a ramp portion 355 that mates with a contour formed by the tapered portions 340, 345. The outer portion of the pads 305 includes a profile, such as a radius profile, to increase the contact stresses between the expander tool 300 and the material to be expanded.

As further illustrated, a dog assembly 370 is disposed below the expander tool 300 and proximate the liner seal 155. The dog assembly 370 includes a plurality of dogs 325 constructed and circumferentially arranged around a support 330. A shearable member, such as a shear ring 335, operatively attaches the support 330 to the liner assembly 150.

Figure 10:
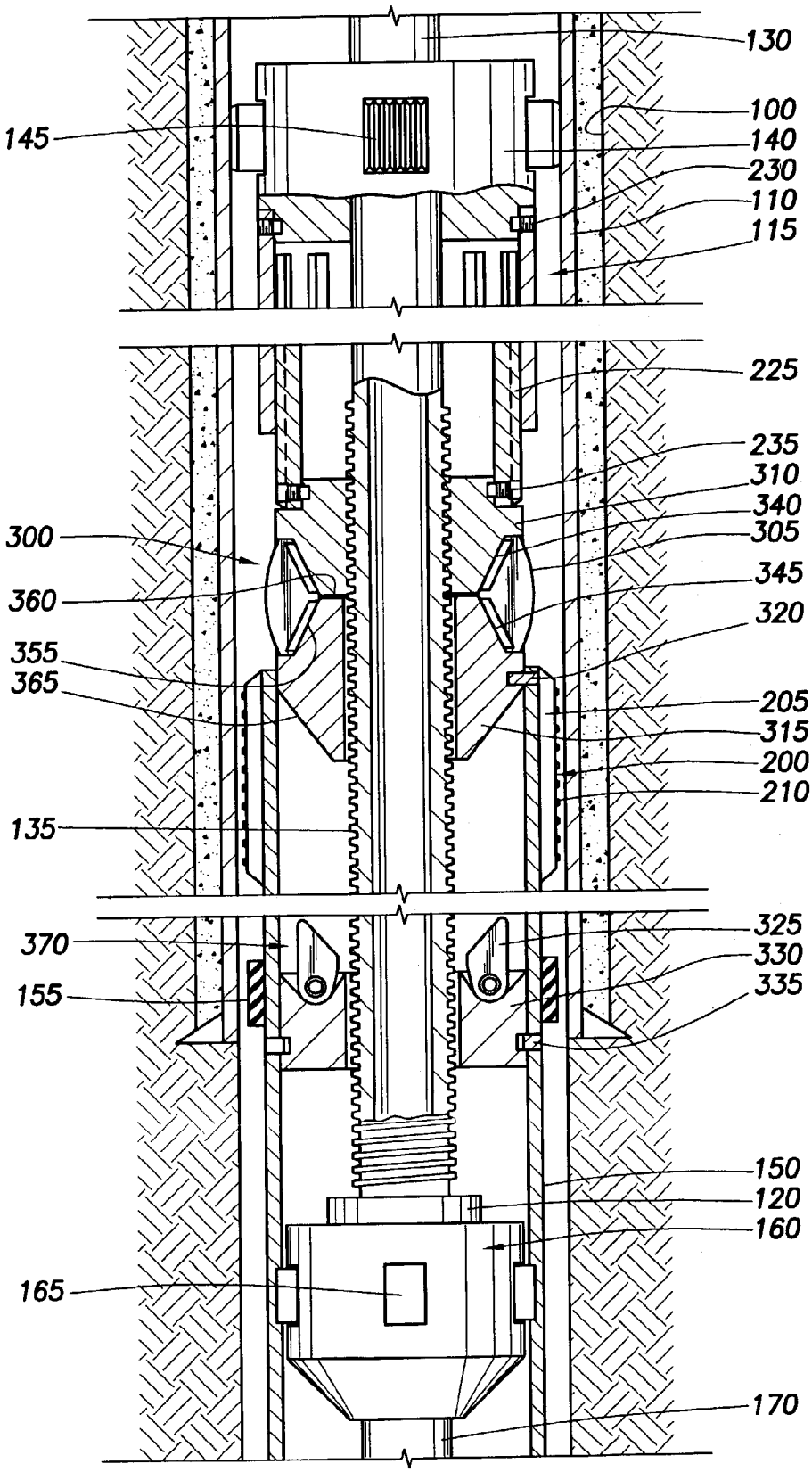
FIG. 10 is a cross-sectional view illustrating the collapsible expander tool in an activated position prior to the expansion of the expandable hanger.

FIG. 10 is a cross-sectional view illustrating the collapsible expander tool 300 in an activated position prior to the expansion of the expandable hanger 200. As shown, the liner assembly 150 is positioned proximate the lower end of the casing 110. Thereafter, the upper torque anchor 140 is actuated, thereby extending the pads 145 radially outward into contact with the surrounding casing 110. Subsequently, rotational force is transmitted through the working string 130 to the threaded mandrel 135. The swivel 120 permits the threaded mandrel 135 to rotate while the torque anchor 140, the spline assembly 225, expander tool 300, and liner assembly 150 remain rotationally stationary. As the threaded mandrel 135 rotates, the upper cone 310 moves axially toward the lower cone 315 closing the gap 360. At the same time, the pads 305 move radially outward as the ramped portion 355 rides up the tapered portions 340, 345. After the upper cone 310 is in substantial contact with the lower cone 315, the entire expander tool 300 creates a force on the plurality of shear pins 320. At a predetermined force, the shear pins 320 fail thereby permitting the expander tool 300 to move axially within the hanger 200.

Figure 11:
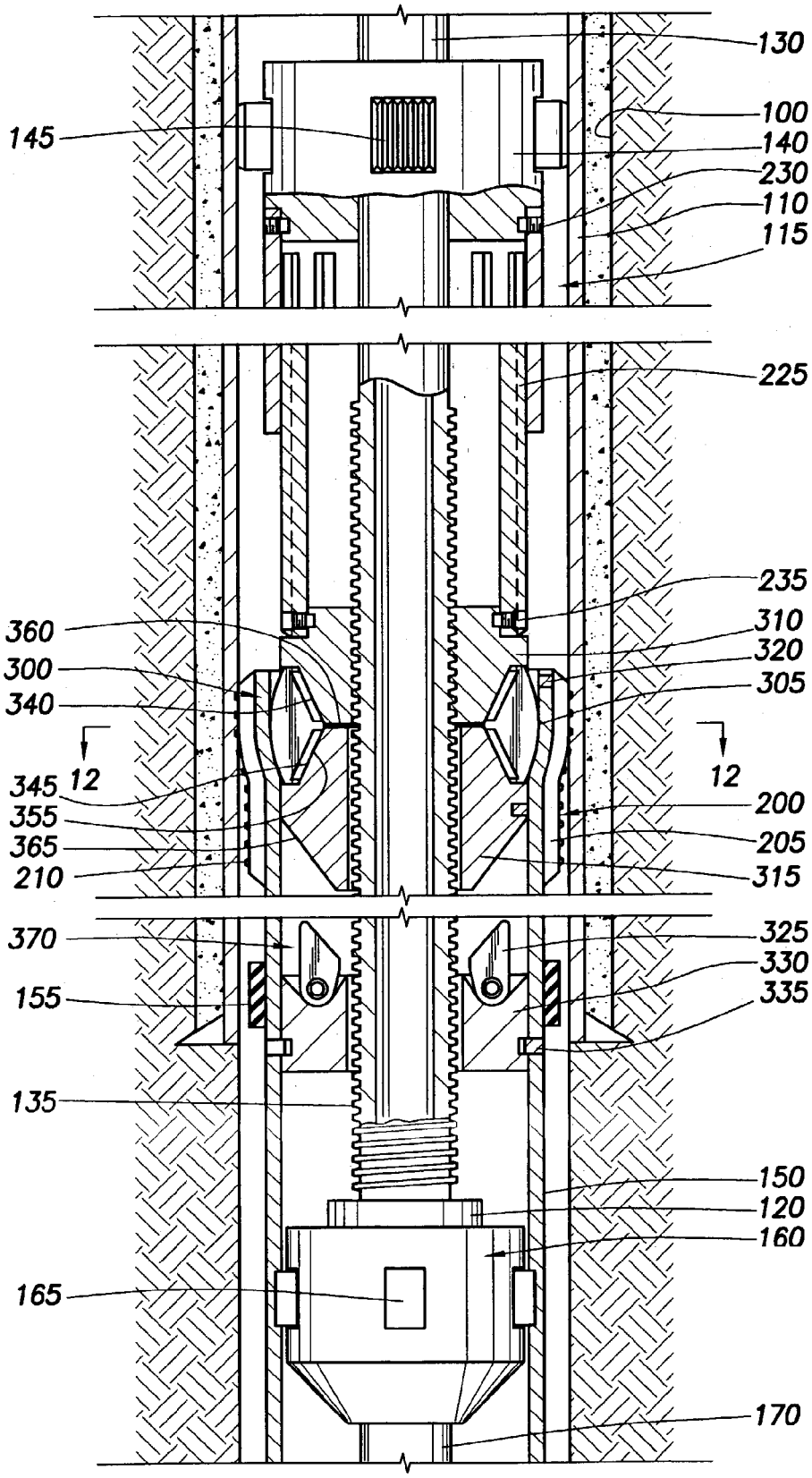
FIG. 11 is a cross-sectional view illustrating the expander tool partially expanding the expandable hanger.

FIG. 11 is a cross-sectional view illustrating the expander tool 300 partially expanding the expandable hanger 200. As the threaded mandrel 135 rotates, the expander tool 300 moves axially through the expandable hanger 200 forcing the inserts 210 to contact the inner surface of the casing 110 as the hanger 200 expands radially outward. The expander tool 300 continues to expand the entire length of the expandable hanger 200 until it reaches a predetermined point above the liner seal 155. At that point, the expansion is stopped to prevent expanding the liner seal 155, in anticipation of cementing.

Figure 12:
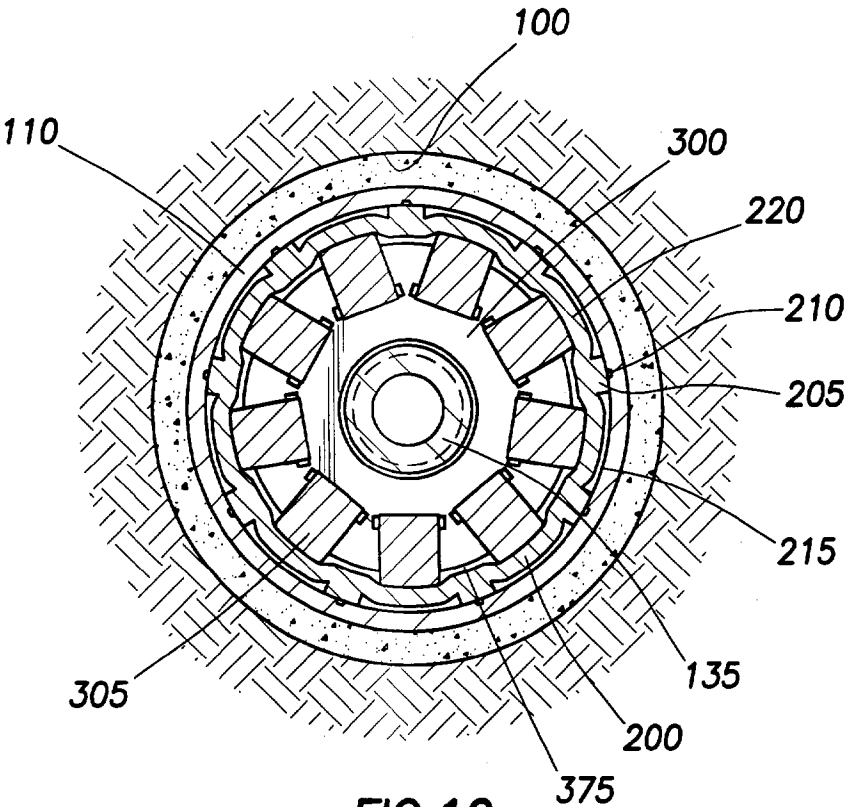
FIG. 12 is a cross-sectional view taken along line 12—12 in FIG. 11 illustrating the expander tool during the expansion of the expandable hanger.

FIG. 12 is a cross-sectional view taken along line 12—12 in FIG. 11 illustrating the expander tool 300 during the expansion of the expandable hanger 200. As clearly shown, the plurality of pads 305 are circumferentially spaced around the expander tool 300 and the plurality of pads 305 are aligned with the hanger flutes 220. Therefore, as the expander tool 300 moves axially through the hanger 200, the plurality of pads 305 apply a force on the hanger flutes 220, causing them to expand out radially, which in turn urges the ribs 205 on the hanger 200 out radially as the inserts 210 penetrate the surrounding casing 110. At this point the hanger flutes 220 are free to move out radially while the flutes 185 accommodate the radially stationary ribs 205. In other words, the expandable hanger 200 includes a compliant slip system that allows the hanger ribs 205 to conform to the surrounding casing 110 as the expander tool 300 urges the expandable hanger 200 radially outward. Given that the radial extension of the hanger flutes 220 are dictated by the diameter of the pads 305, they never contact the surrounding casing 110. In this manner, the cement bypass ports 215 are formed therefore providing a fluid passageway between the hanger 200 and the surrounding casing 110 during the cementing operation.

Figure 13:
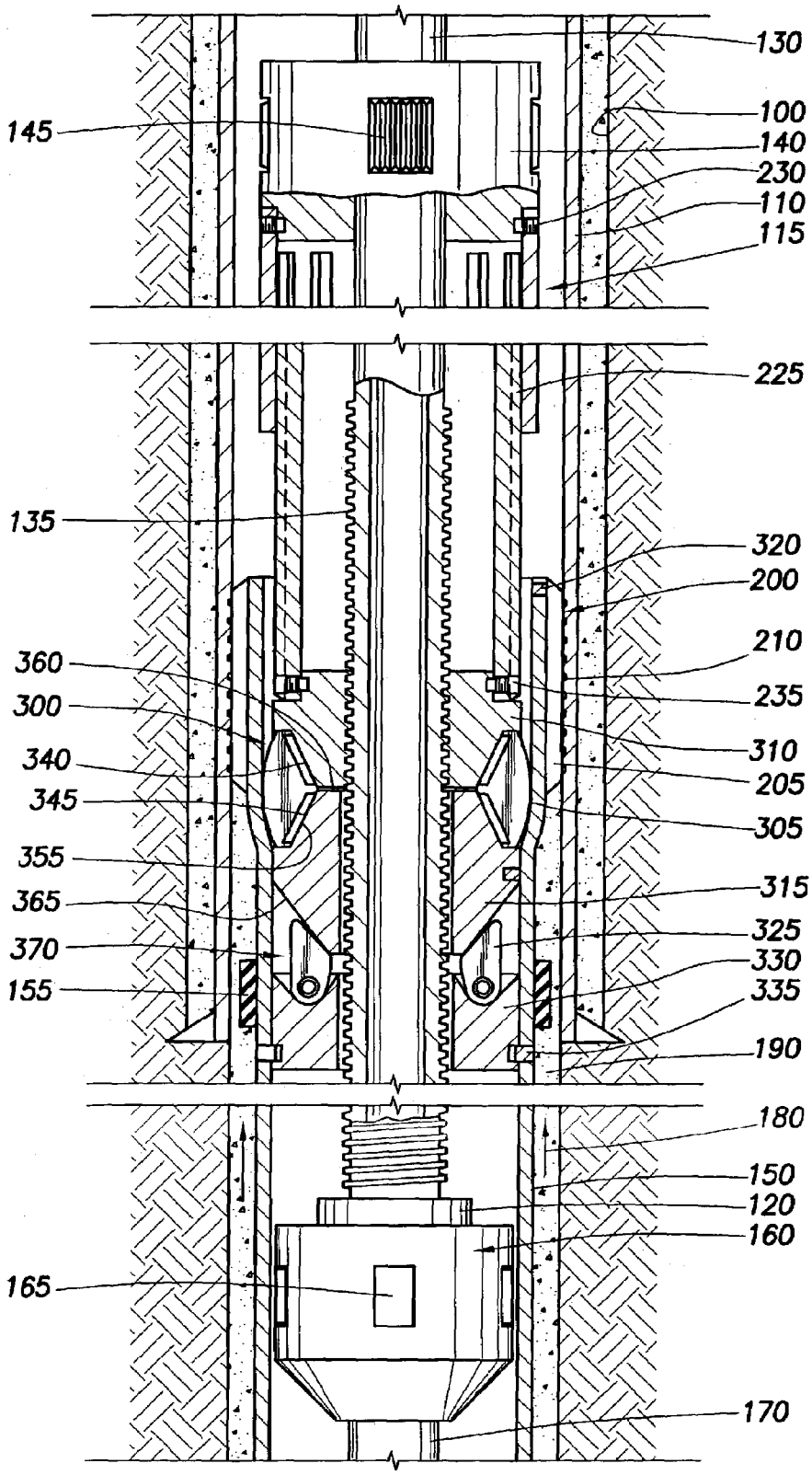
FIG. 13 is a cross-sectional view illustrating the cementation of the liner assembly within the wellbore.

FIG. 13 is a cross-sectional view illustrating the cementation of the liner assembly 150 within the wellbore 100. After the hanger 200 is expanded to the predetermined point above the liner seal 155, the expander tool 300 is moved proximate the top of the hanger 200. Thereafter, the torque anchor 140 and lower anchor 160 are deactivated and then cement is pumped through the working string 130, the running tool 115, and the fluid outlet 170 to a cement shoe (not shown) or another means known in the art to distribute the cement. As indicated by arrow 180, the cement is circulated up an annulus 190 formed between the liner assembly 150 and the wellbore 100 and past the liner seal 155 into the cement bypass ports (not shown) of the expandable hanger 200. Thereafter, the cement flows through the bypass ports and exits into an inner diameter of the surrounding casing 110.

Figure 14:
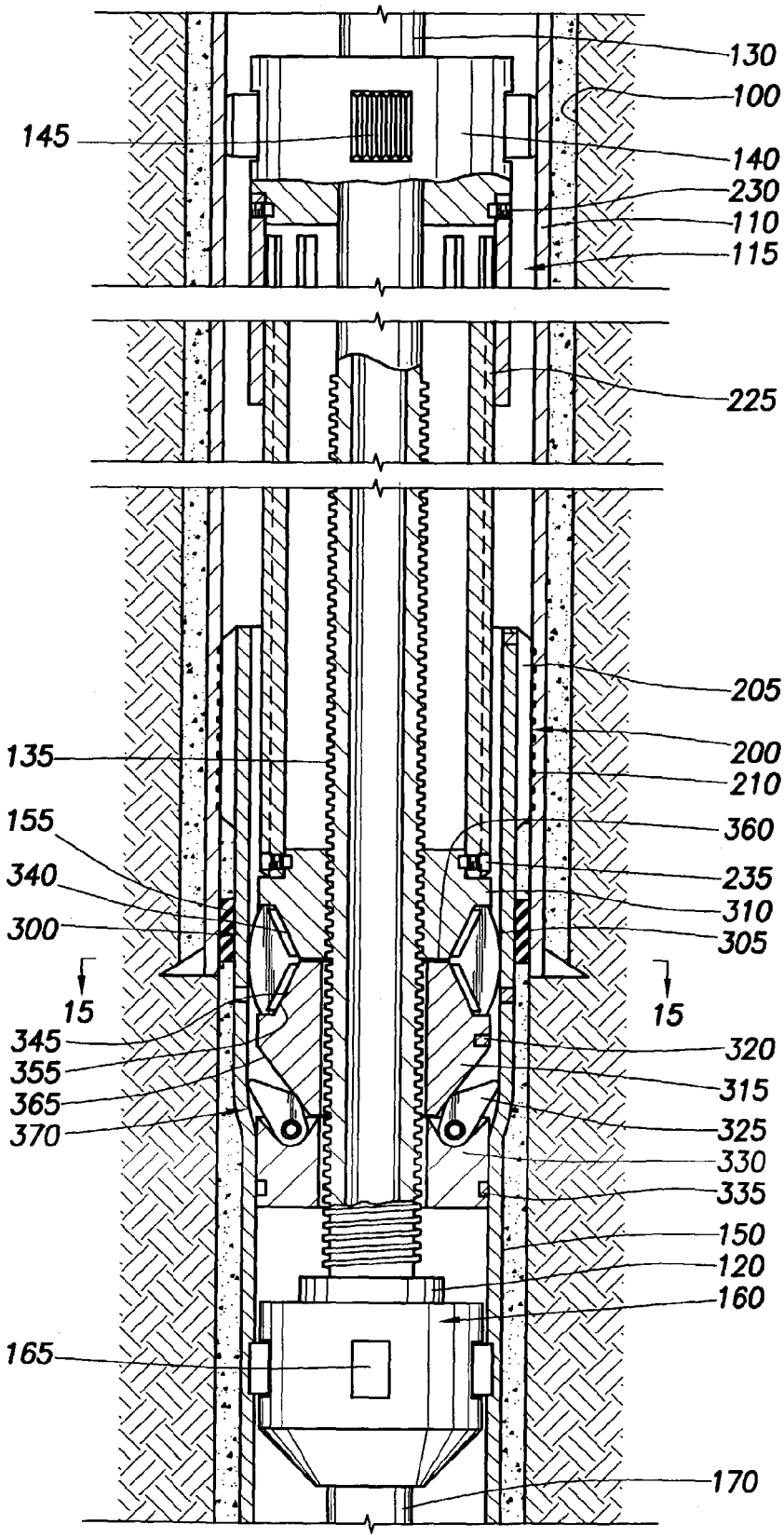
FIG. 14 is a cross-sectional view illustrating the expansion of the liner seal after the cementing operation.

FIG. 14 is a cross-sectional view illustrating the expansion of the liner seal 155 after the cementing operation. As shown, the liner assembly 150 has been completely cemented in the wellbore 100. As further shown, the torque anchor 140 and lower anchor 160 are once again actuated, thereby extending the pads 145,165 radially outward. Subsequently, rotational force is transmitted through the working string 130 to the threaded mandrel 135. The swivel 120 permits the threaded mandrel 135 to rotate while the supporting torque anchor 140, the spline assembly 225, and the expander tool 300 remain rotationally stationary. As the threaded mandrel 135 rotates, the expander tool 300 moves axially through the expanded portion of the hanger 200 until the lower cone 315 contacts the plurality of dogs 325. At that point, the second tapered portion 365 urges the plurality of dogs 325 radially outward into contact with the surrounding hanger 200 and at the same time creates an axial force on the shear ring 335. At a predetermined force, the shear ring 335 fails thereby permitting the expander tool 300 and the dog assembly 370 to move axially in the liner assembly 150. The axial movement of the expander tool 300 and the dog assembly 370 expands the liner seal 155 radially outward forcing the elastomeric material to form a fluid seal between the liner assembly 150 and the surrounding casing 110.

Figure 15:
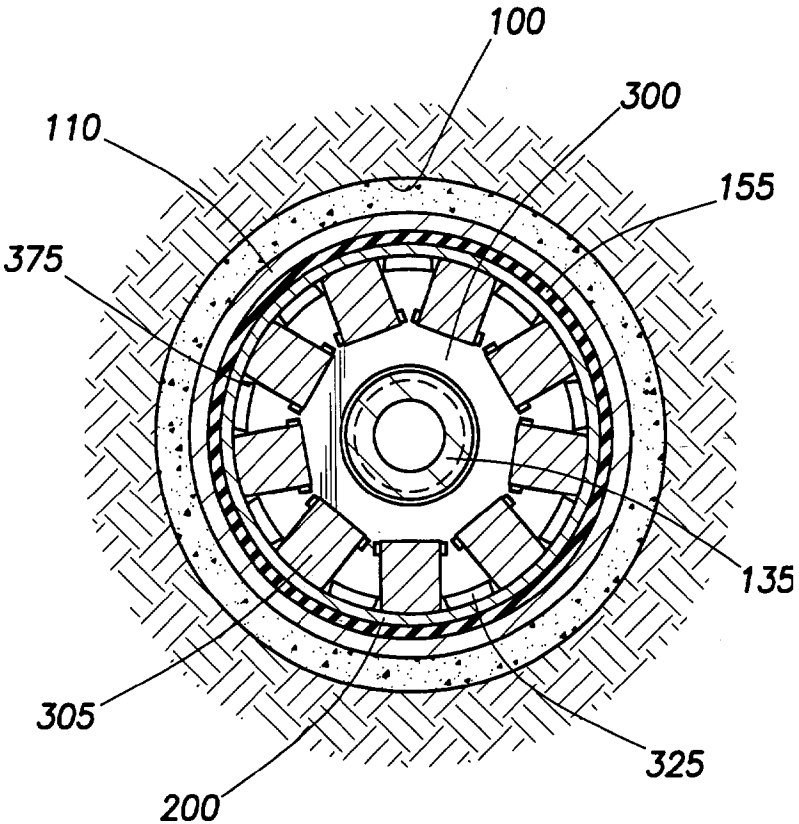
FIG. 15 is a cross-sectional view taken along line 15—15 in FIG. 14 illustrating the expander tool and the plurality of dogs during the expansion of the liner seal.

FIG. 15 is a cross-sectional view taken along line 15—15 in FIG. 14 illustrating the expander tool 300 and the plurality of dogs 325 during the expansion of the liner seal 155. As clearly shown, the plurality of dogs 325 are spaced circumferentially between the plurality of pads 305 to fill a plurality of spaces 375. It should be understood, however, that other components may be employed to fill the spaces 375 between the pads 305, such as collet or any other suitable components known in the art.

In the embodiment shown, the entire outer perimeter of the liner seal 155 is radially expanded into contact with the surrounding casing 110. In other words, after the plurality of dogs 325 expand a portion of the liner seal 155 into contact with the casing 110 then the plurality of pads 305 expand the remainder of the liner seal 155 into contact with the casing 110. In this manner, the cement bypass ports (not shown) are sealed off to prevent any further migration of fluid through the expandable hanger 200 from micro-annuluses that may have formed during the cementing operation.

Figure 16:
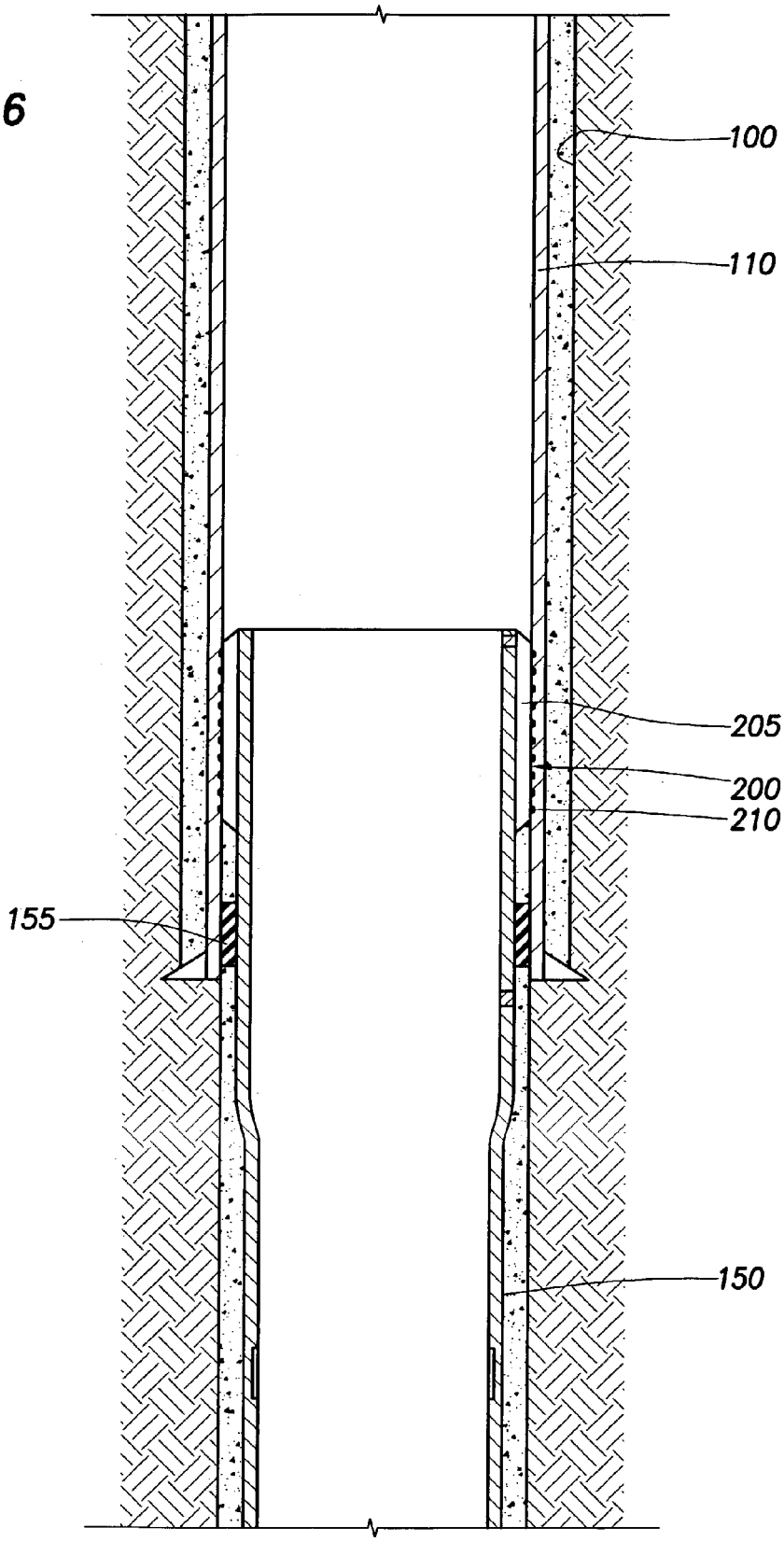
FIG. 16 is a cross-sectional view illustrating the fully expanded expandable hanger after the running tool has been removed.

FIG. 16 is a cross-sectional view illustrating the fully expanded expandable hanger 200 after the running tool 115 has been removed. As shown, the expandable hanger 200 is fully engaged with the lower portion of the surrounding casing 110 and consequently supporting the entire weight of the liner assembly 150 by way of the inserts 210 on the hanger ribs 205. As further shown, the liner seal 155 has been expanded radially outward and is therefore creating the lower fluid seal between the liner assembly 150 and the surrounding casing 110.

Figure 17:
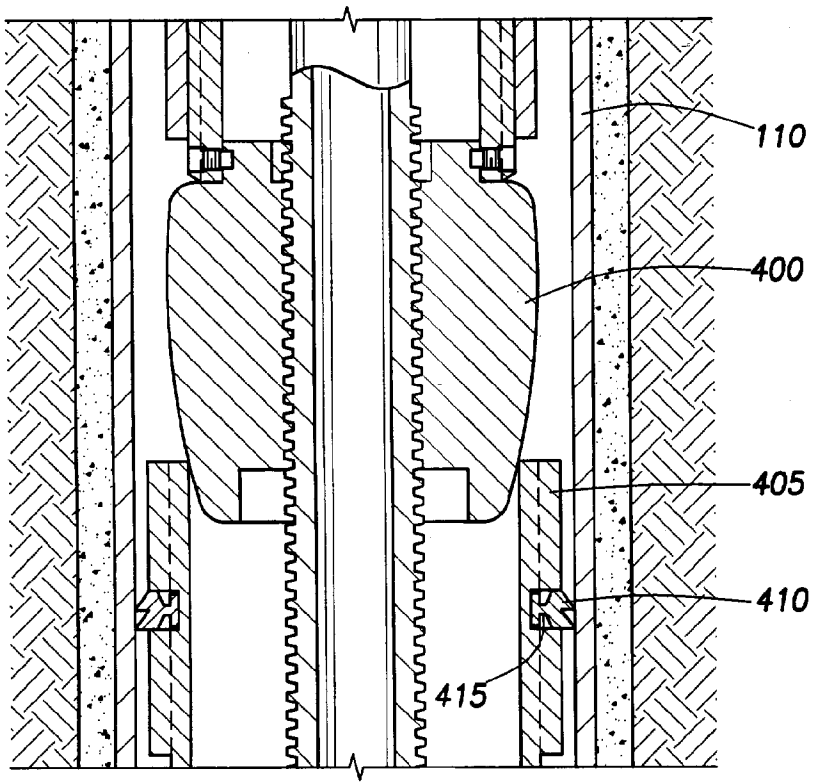
FIG. 17 is a cross-sectional view illustrating an alternative embodiment of an expandable hanger with compliant slip system.

FIG. 17 is a cross-sectional view illustrating an alternative embodiment of an expandable hanger 405 with compliant slip system. In this embodiment, the expandable hanger 405 includes a plurality of griping members 410 disposed circumferentially therearound. The gripping members 410 include a reduced portion 415 that is constructed and arranged to buckle or fail at a predetermined load. In other words, the expandable hanger 405 includes a compliant slip system that allows the gripping members 410 to conform the hanger 405 to a surrounding casing 110 as an expander tool 400 urges the expandable hanger 405 radially outward.

Figure 18:
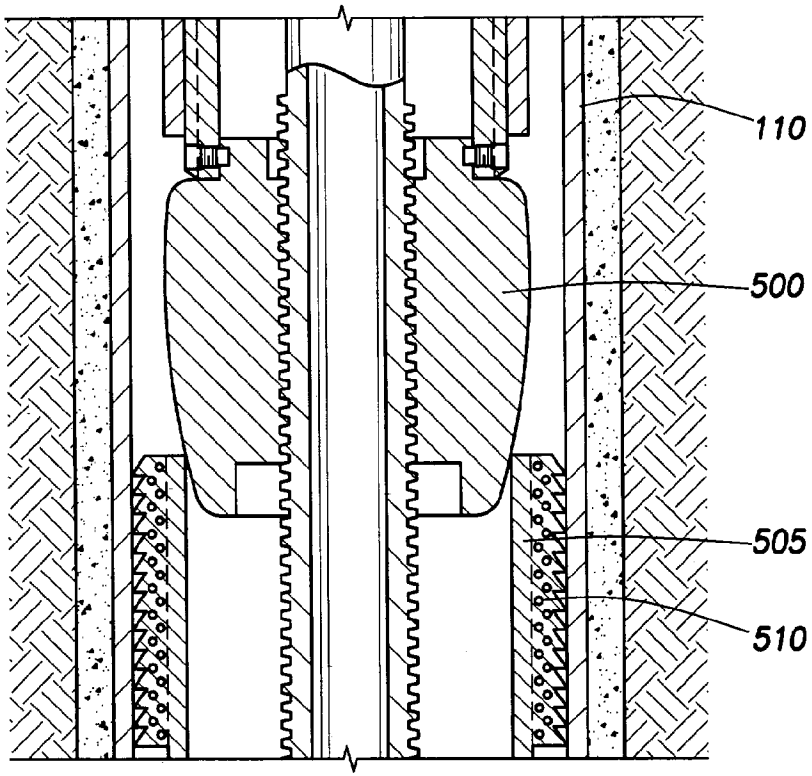
FIG. 18 is a cross-sectional view illustrating an alternative embodiment of an expandable hanger with compliant slip system.

FIG. 18 is a cross-sectional view illustrating an alternative embodiment of an expandable hanger 505 with compliant slip system. In this embodiment, the expandable hanger 505 includes a plurality of holes 510 formed in the hanger 505. The plurality of holes 510 are constructed and arranged to collapse at a predetermined load. In other words, the expandable hanger 505 includes a compliant slip system that allows the hanger 505 to conform to a surrounding casing 110 as an expander tool 500 urges the expandable hanger 505 radially outward.

Figure 19:
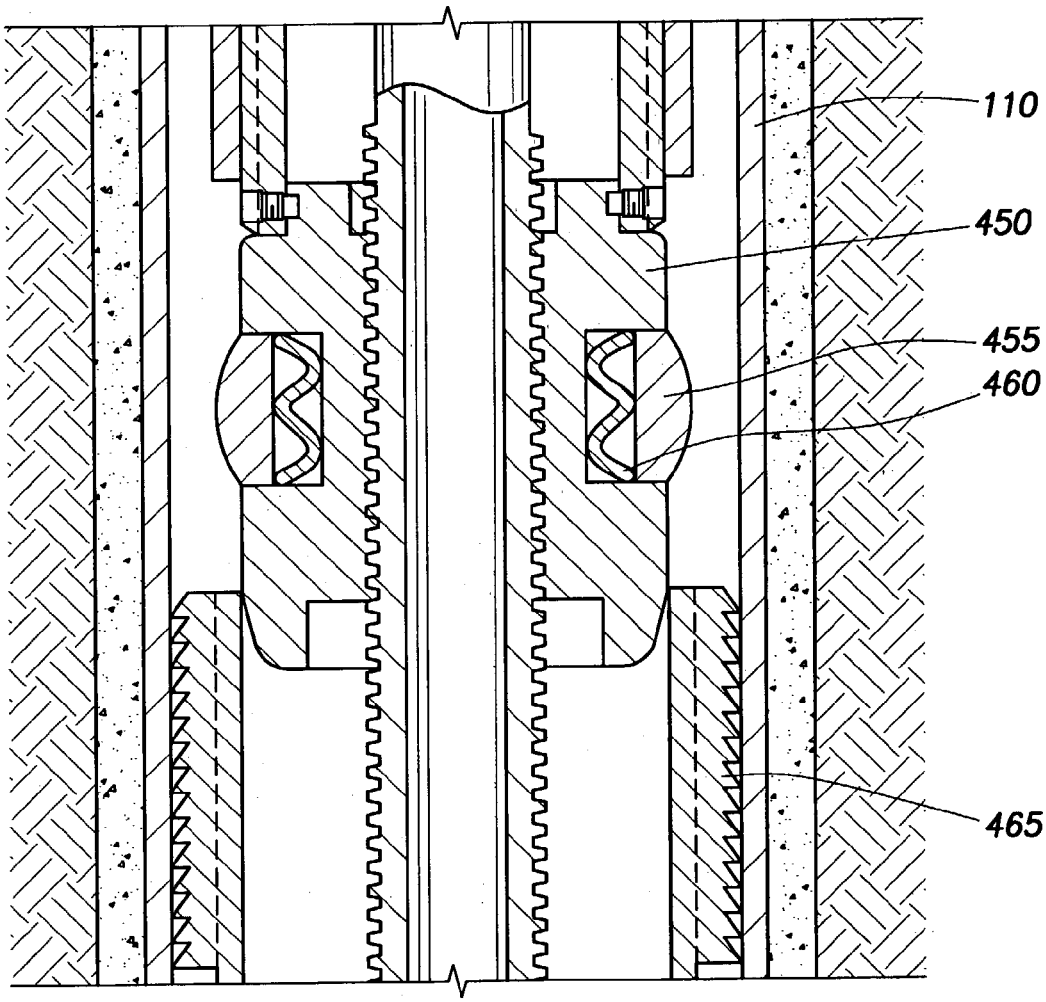
FIG. 19 is a cross-sectional view illustrating an expander tool with compliant expansion member.

FIG. 19 is a cross-sectional view illustrating an expander tool 450 with compliant expansion member 455. In this embodiment, the expander tool 450 includes a forgiving member 460 disposed behind the expansion member 455. The forgiving member 460 is constructed and arranged to deform at a predetermined load. In other words, the expansion member 455 moves radially inward at the predetermined load to ensure that a hanger 465 conforms to a surrounding casing 110 as the expander tool 450 urges the expandable hanger 465 radially outward.

While the foregoing is directed to embodiments of the present invention, other and further embodiments of the invention may be devised without departing from the basic scope thereof, and the scope thereof is determined by the claims that follow.

The invention claimed is:

1. An apparatus for forming an expanded connection in a wellbore, the apparatus comprising:

a first tubular radially expandable outward into contact with an inner wall of a second tubular; and a plurality of outwardly extending formations formed on an outer surface of the first tubular arranged to provide a frictional relationship between the first tubular and the second tubular upon the application of an outwardly directed force supplied to an inner surface of the first tubular between the formations, whereby a fluid path is created when the first tubular is expanded to engage the inner wall of the second tubular.

2. The apparatus of claim 1, further including gripping means formed on the plurality of formations for further increasing friction between the first and second tubulars upon expansion of the first tubular.

3. The apparatus of claim 2, wherein the gripping means define raised members extending outward from an outer surface of the plurality of formations.

4. The apparatus of claim 3, wherein the raised members define inserts that are press-fitted, epoxied, soldered, threaded, or combinations thereof into preformed apertures in the outer surface of the plurality of formations.

5. The apparatus of claim 4, wherein the inserts are fabricated from a hardened metal alloy.

6. The apparatus of claim 4, wherein the inserts are fabricated from a ceramic material.

7. The apparatus of claim 4, wherein the inserts define a plurality of buttons having teeth.

8. The apparatus of claim 1, further including at least one tubular seal disposed on the outer surface of the first tubular, wherein the at least one tubular seal is radially expandable to create an annular fluid seal between the first and second tubulars.

9. The apparatus of claim 8, wherein the at least one tubular seal is fabricated from an elastomeric material.

10. The apparatus of claim 1 wherein an expander tool supplies the outwardly directed force.

11. The apparatus of claim 10, wherein the expander tool includes a plurality of ribs on an outer surface thereof, the ribs define a first outer diameter at a first location smaller than a second outer diameter at a second location.

12. The apparatus of claim 11, wherein the expander tool is oriented in the first tubular such that the plurality of ribs are positioned between the plurality of formations on the first tubular.

13. The apparatus of claim 11, wherein the expander tool further includes a plurality of selectively extendable elements to substantially fill a space between the plurality of ribs resulting in the expander tool having a substantially uniform outer diameter.

14. An apparatus for forming an expandable connection in a wellbore, the apparatus comprising:

a first tubular radially expandable outward into contact with an inner wall of a second tubular upon the application of an outwardly directed force supplied to an inner surface of the first tubular; and a compliant slip system formed on an outer surface of the first tubular, the compliant slip system constructed and arranged to selectively deform to permit the first tubular to conform to the inner wall of the second tubular while providing a frictional relationship between the first tubular and the second tubular, wherein the compliant slip system comprises a plurality of holes formed in the first tubular that are constructed and arranged to collapse at a predetermined load.

15. The apparatus of claim 14, wherein the compliant slip system comprises a plurality of griping members having a reduced portion that is constructed and arranged to fail at a predetermined load.

16. A method of compliantly expanding a tubular into contact with a casing wall, comprising:

placing the tubular at a predefined location within the casing, the tubular having at least two outwardly extending, substantially longitudinal formations formed on an outer surface thereof; and passing an expander tool through an inside diameter of the tubular to expand its outer diameter, the expander tool having at least two substantially longitudinal ribs formed on an outer surface thereof, the expander tool centered within the tubular in a manner whereby the at least two ribs are misaligned with the at least two formations providing a compliant force between the at least two formations and the casing wall.

17. The method of claim 16, further including circulating cement between the expanded tubular and the casing wall, the cement traveling in a fluid path formed between the at least two formations.

18. The method of claim 17, further including sealing the fluid path.

19. An apparatus for expanding a tubular, comprising:

a body; and a plurality of fixed outwardly extending substantially longitudinal formations formed on the body, wherein the plurality of formations are capable of expanding the tubular and define a first smaller outer diameter of the body and a second larger outer diameter of the body, wherein the plurality of formations are constructed and arranged to be orientated in an alternating relationship between a plurality of ribs formed on a tubular to expand the tubular into contact with a larger tubular while leaving a fluid path therebetween.

20. The apparatus of claim 19, wherein the first smaller outer diameter is defined at a first end of the body.

21. The apparatus of claim 20, further including a second smaller diameter of the body defined opposite the first end.

22. The apparatus of claim 19, wherein a tapered interface is formed between the first smaller outer diameter arid the second larger outer diameter.

23. The apparatus of claim 19, wherein a plurality of substantially longitudinal flutes are equally spaced around a circumference of the body between the plurality of formations.

24. The apparatus of claim 23, wherein the plurality of substantially longitudinal flutes extend along the entire length of the body.

25. The apparatus of claim 23, further including a plurality of selectively extendable elements disposed in the plurality of substantially longitudinal flutes.

26. The apparatus of claim 25, wherein the plurality of selectively extendable elements extend radially outward upon activation to substantially fill the plurality of substantially longitudinal flutes resulting in the apparatus having a substantially uniform outer diameter.

27. An expandable apparatus for expanding a tubular, comprising:

an upper member having a tapered portion on an outer surface thereof;

a lower member having an oppositely tapered portion on an outer surface thereof, whereby the tapered portions are movable towards each other; and a plurality of pads disposed between the tapered portions, the pads extendable outwards to increase an outer diameter of the apparatus when the tapered portions are moved toward each other.

28. The expandable apparatus of claim 27, wherein a thread drive moves the tapered portions toward each other.

29. The expandable apparatus of claim 27, wherein a hydraulic cylinder moves the tapered portions toward each other.

30. The expandable apparatus of claim 27, wherein the plurality of pads are circumferentially spaced around the expandable apparatus.

31. The expandable apparatus of claim 30, wherein a plurality of spaces are formed between the plurality of pads.

32. The expandable apparatus of claim 31, further including an extendable component to fill the plurality of spaces.

33. The expandable apparatus of claim 32, wherein the extendable component is a dog assembly.

34. The expandable apparatus of claim 27, wherein the pads move radially outward as the pads slide along the tapered portions.

35. A method of completing a wellbore, comprising:

positioning a first tubular coaxially within a portion of a second tubular, the first tubular including at least one tubular seal disposed therearound and a plurality of outwardly extending formations on an outer surface thereof to provide a frictional relationship between the first tubular and the second tubular while leaving a fluid path through the expanded connection;

positioning an expandable apparatus within the first tubular at a depth proximate the plurality of formations on the first tubular, the expandable apparatus includes a plurality of selectively extendable members and the expandable apparatus includes a forgiving member disposed behind each selectively extendable member, whereby the forgiving member is constructed and arranged to deform at a predetermined load;

activating the expandable apparatus by extending the plurality of selectively extendable members radially outward;

urging the expandable apparatus axially through at least a portion of the first tubular to expand the first tubular into frictional contact with the second tubular; and forming a fluid path through an overlapped portion between the first and second tubulars.

36. The method of claim 35, wherein a plurality of flutes are formed between the plurality of formations on the outer surface of the first tubular.

37. The method of claim 36, further including orientating the expandable apparatus such that the plurality of selectively extendable members are aligned with the plurality of flutes.

38. An apparatus for forming an expandable connection in a wellbore, the apparatus comprising:

a first tubular radially expandable outward into contact with an inner wall of a second tubular upon the application of an outwardly directed force supplied to an inner surface of the first tubular;

a compliant slip system formed on an outer surface of the first tubular, the compliant slip system comprising a plurality of ribs with a plurality of flutes therebetween; and an expander device having a plurality of radially outwardly extending members, wherein the expander device is positionable within the first tubular in a manner whereby the outwardly extending members are misaligned with the plurality of ribs to apply a force to the Inner surface of the first tubular opposite the flutes.

39. The apparatus of claim 38, wherein the compliant slip system is constructed and arranged to permit the first tubular to conform to the inner wall of the second tubular while providing a frictional relationship between the first tubular and the second tubular.

40. A method of completing a wellbore, comprising:

positioning a first tubular coaxially within a portion of a second tubular, the first tubular including a plurality of outwardly extending formations on an outer surface thereof to provide a frictional relationship between the first tubular and the second tubular while leaving a fluid path through the expanded connection;

positioning an expander tool within the first tubular at a depth proximate the plurality of formations on the first tubular, wherein the expander tool includes a plurality of ribs formed circumferentially around an outer surface thereof;

orientating the expander tool such that the plurality of ribs are misaligned with the plurality of formations;

urging the expander tool axially through the first tubular to expand the first tubular into frictional contact with the second tubular; and forming a fluid path through an overlapped portion between the first and second tubulars.

41. The method of claim 40, further including circulating cement through the wellbore and subsequently through the fluid path to secure the first tubular in the wellbore.

42. The method of claim 40, wherein at least one tubular seal is disposed around the first tubular.

43. The method of claim 46, further including expanding the at least one tubular seal to close off the fluid path and create a fluid seal between the first and second tubulars.

44. A method of completing a wellbore, comprising:

positioning a first tubular coaxially within a portion of a second tubular, the first tubular including at least one tubular seal disposed therearound and a plurality of outwardly extending formations on an outer surface thereof to provide a frictional relationship between the first tubular and the second tubular while leaving a fluid path through the expanded connection;

positioning an expandable apparatus within the first tubular at a depth proximate the plurality of formations on the first tubular, the expandable apparatus includes a plurality of selectively extendable members;

activating the expandable apparatus by extending the plurality of selectively extendable members radially outward;

urging the expandable apparatus axially through at least a portion of the first tubular to expand the first tubular into frictional contact with the second tubular;

forming a fluid path through an overlapped portion between the first and second tubulars; and activating an extendable component to fill a plurality of spaces between the plurality of selectively extendable members.

45. The method of claim 44, further including closing the fluid path and creating a fluid seal between the first and second tubulars.

46. The method of claim 45, wherein the fluid path is closed by expanding the at least one tubular seal with the expandable apparatus and the extendable component.

* * * * *